US011454029B2

(12) United States Patent
Liu

(10) Patent No.: US 11,454,029 B2
(45) Date of Patent: Sep. 27, 2022

(54) RAIN GUTTER DREDGER AND USE THEREOF

(71) Applicant: Xiang Liu, Berwyn, PA (US)

(72) Inventor: Xiang Liu, Berwyn, PA (US)

(73) Assignee: Xiang Liu, Berwyn, PA (US)

( * ) Notice: Subject to any disclaimer, the term of this patent is extended or adjusted under 35 U.S.C. 154(b) by 514 days.

(21) Appl. No.: 16/724,250

(22) Filed: Dec. 21, 2019

(65) Prior Publication Data

US 2020/0199879 A1 Jun. 25, 2020

Related U.S. Application Data

(60) Provisional application No. 62/783,393, filed on Dec. 21, 2018.

(51) Int. Cl.
*E04D 13/076* (2006.01)
*E04D 13/08* (2006.01)
*E04D 13/064* (2006.01)

(52) U.S. Cl.
CPC ..... *E04D 13/0765* (2013.01); *E04D 13/064* (2013.01); *E04D 13/08* (2013.01); *E04D 2013/0866* (2013.01)

(58) Field of Classification Search
CPC ... E04D 13/0765; E04D 13/064; E04D 13/08; E04D 2013/0866; E04D 13/04; E04D 13/0404; E04D 13/0409; E04D 13/0431; E04D 13/0459; E04D 2013/0422
USPC ..... 52/12
See application file for complete search history.

(56) References Cited

U.S. PATENT DOCUMENTS 23,925 A * 5/1859 Lewis ..... E04D 13/08 137/120
3,121,684 A * 2/1964 Bugbird ..... E04D 13/0409 210/474
3,157,002 A * 11/1964 Herman ..... E04D 13/076 52/12
3,638,369 A * 2/1972 Albrecht ..... E04D 13/08 52/16
4,602,460 A * 7/1986 Langenbach ..... E04D 13/08 210/111
5,482,084 A * 1/1996 Cassidy ..... E04D 13/08 137/120
5,802,775 A * 9/1998 Toth ..... E04D 13/076 52/12
6,397,526 B1 * 6/2002 Saul ..... E04D 13/0767 52/302.1
7,775,232 B2 * 8/2010 Takai ..... E03B 3/02 137/433
10,744,510 B1 * 8/2020 Plemmons ..... B02C 25/00
(Continued)

*Primary Examiner* — Babajide A Demuren
(74) *Attorney, Agent, or Firm* — Gann G. Xu

(57) ABSTRACT

This disclosure is directed to a system designed for automatic de-clogging a rain gutter and a downspout. The system (also referred to as a gutter dredger) comprises a motion device (motor) and a cleaning device. When it is raining, rain water can power the system to cause reciprocating motions of the cleaning device that can result in de-clogging of a gutter and a downspout that have the system installed. A debris removal device may be positioned in the downspout to remove big debris before it moves into the motor. The gutter dredger can be used for automatically de-clogging a gutter and downspout whenever it is raining.

20 Claims, 12 Drawing Sheets

(56) References Cited

U.S. PATENT DOCUMENTS

2003/0167700 A1* 9/2003 Esmond ..... E04D 13/08
52/12

* cited by examiner

RAIN GUTTER DREDGER AND USE THEREOF

CROSS REFERENCE

This application claims the priority of a U.S. provisional application Ser. No. 62/783,393 filed on Dec. 21, 2018, which is hereby incorporated by reference.

FIELD OF THE DISCLOSURE

This invention is directed to an automatic process and a rain-water powered self-cleaning system for de-clogging a rain gutter and connected downspout.

BACKGROUND

Most residential and commercial buildings have a rain gutter system along their roofline. The rain gutters collect rain water flowing down from the roof and channel the rain water down downspouts to the ground. Rain gutters are very easy to be blocked by debris such as leaves, pine needles, seed pods and so on, that can fall in or flow into the gutters. The debris may accumulate in the gutter and the connected downspout that can clog and even completely stop water flow down through the downspout. Blockage of the rain gutter and the downspout can cause water accumulation at the roof or water over-spill from the roofline leading to damages to the house. Due the typical high location around the house, the rain gutter and the connected downspout are difficult to clean or de-clog and may require professional services.

Many different types of systems and methods have been developed to clean the rain gutter or to keep the rain gutter from being clogged. U.S. Pat. No. 5,406,966 discloses a spray system to jet clean a section of rain gutter. U.S. Pat. No. 6,185,782 discloses a vacuum system to provide suction and removal of debris. U.S. Pat. No. 7,909,274 discloses a grinder system to grind debris for easy removal. U.S. Pat. No. 7,926,141 discloses a manual impeller to clean the gutter. U.S. Pat. No. 8,464,474 discloses an assembly that can rotate a section of a gutter to remove debris. U.S. Pat. No. 8,656,947 discloses a self-evacuating downspout adaptor that can be adjusted on-demand to remove accumulated debris. U.S. Pat. No. 9,175,477 discloses a system to blow air into a downspout to force the debris out of the rain gutter from the top end. Most current commercial products are using a net or cover in an attempt to prevent debris entering into the rain gutter. However, there commercial products often get clogged after a short period of time due to the stationary nature of the products. So far, all the systems or methods are not very effective and also require manual operation. Thus, there are needs for a device to dredge the clogged downspout and allow the rain to continuously flow down to the ground through the downspout.

SUMMARY

The present invention is directed to a process for automatic de-clogging a rain gutter and a downspout coupled to the rain gutter, the process comprising causing uni-directional motions or oscillating motions of a cleaning member of a cleaning device coupled to a set of motion connectors, the cleaning device is positioned within a portion of the rain gutter, the downspout or a combination thereof, wherein the uni-directional motions or oscillating motions are caused by manual operations, caused by directing a liquid from an upper opening of a downspout that is coupled to a rain gutter through the downspout to a motion device functionally coupled to the set of motion connectors, or a combination thereof, wherein the motion device is configured to drive the uni-directional motions or oscillating motions of the cleaning member based on motions of the liquid flowing through the downspout and through said motion device caused by gravity.

The present invention is also directed to a system for de-clogging a rain gutter and a downspout coupled to the rain gutter, the system comprising a motion device and a cleaning device comprising a cleaning member functionally coupled to the motion device, wherein the motion device is configured to drive uni-directional motions or oscillating motions of the cleaning member based on motions of a liquid flowing through the rain gutter and the downspout and through the motion device caused by gravity. The system is configured to de-clogging a rain gutter and a downspout automatically when it rains.

The present invention is further directed to a kit for a system for de-clogging a rain gutter and a downspout coupled to the rain gutter. The kit can comprise a motion device selected from a first motion device, a second motion device, or a combination thereof, wherein the motion device is configured to produce uni-directional motions or oscillating motions based on motions of a liquid flowing through the motion device caused by gravity when assembled. The kit can further comprise a cleaning member; a set of motion connectors, wherein the cleaning member and a set of motion connectors are configured to form a cleaning device when assembled; two or more routing devices for routing the set of motion connectors to connect to at least the cleaning member; and optionally, a cranking device configured for manual operation of at least the cleaning device, and, optionally, a debris removal device and a debris exit, the debris removal device and the debris exit are coupled together and both are configured to be positioned at a downspout when assembled.

This invention is further directed to a sound assembly comprising at least one sound device. The sound assembly can be coupled to a motion device disclosed herein or stand-alone.

BRIEF DESCRIPTION OF THE FIGURES

FIG. 1A: showing an example when a motion member is moving downward forced by the accumulating water. FIG. 1B: showing an example when a motion member is at the lower end discharging water accumulated therein while the other motion member is accumulating water.

FIG. 2A: an example of a motion device assembled within a section of a downspout. FIG. 2B: an example of a motion device as a stand-alone unit that comprises a stand-alone motion device housing that is separated from a downspout. FIG. 2C: an example a direction device comprising a pair of trapezoid frames and the closure of one of the two partitions. FIG. 2D: an example a direction device comprising a pair of trapezoid frames and the closure of another partition. Not all elements, features, details, variations or options are shown. The device can be installed in a section of a downspout or a stand-alone device housing shown in dashed lines.

FIG. 3A: a schematic illustration of a side cross sectional view of a motion device. FIG. 3B: a top-down view of debris removal device. FIG. 3C: a top-down view of an example of a direction device with one of the two partitions open. FIG. 3D: a top-down view of a pair of motion members. FIG. 3E: a top-down view of a retention device plate and an additional magnetic plate.

FIG. 8A: a schematic illustration of an example of a cleaning device installed in a rain gutter and a section of an associated downspout. FIG. 8B: a schematic illustration of an example of a cleaning device showing a cleaning member, a gutter hanger, a gutter connecter, a cleaning pulley, and a set of optional cleaning connectors. FIG. 8C: a frontal view of a routing device with a pair of routing pulleys. FIG. 8D: a perspective view of an example of an assembled cleaning device and routing devices positioned in a downspout. FIG. 8E: a schematic illustration of an example of a cleaning device comprises clips or shredding blades. Items may not be to scale. Some optional items may be shown in the Figures.

FIG. 10. A perspective view of an example of an assembled motion device and a debris removal assembly with water and debris flowing through.

FIG. 16A: a sound assembly is installed together with a cleaning device over a rain gutter and a downspout. FIG. 16B: a stand-alone sound assembly connected to a motion device and a debris removal assembly. FIG. 16C: another schematic illustration of an example of a configuration of a sound assembly coupled to a motion device. FIG. 16D-16E: representative examples of a sound device.

DETAILED DESCRIPTION

Figure 1A:
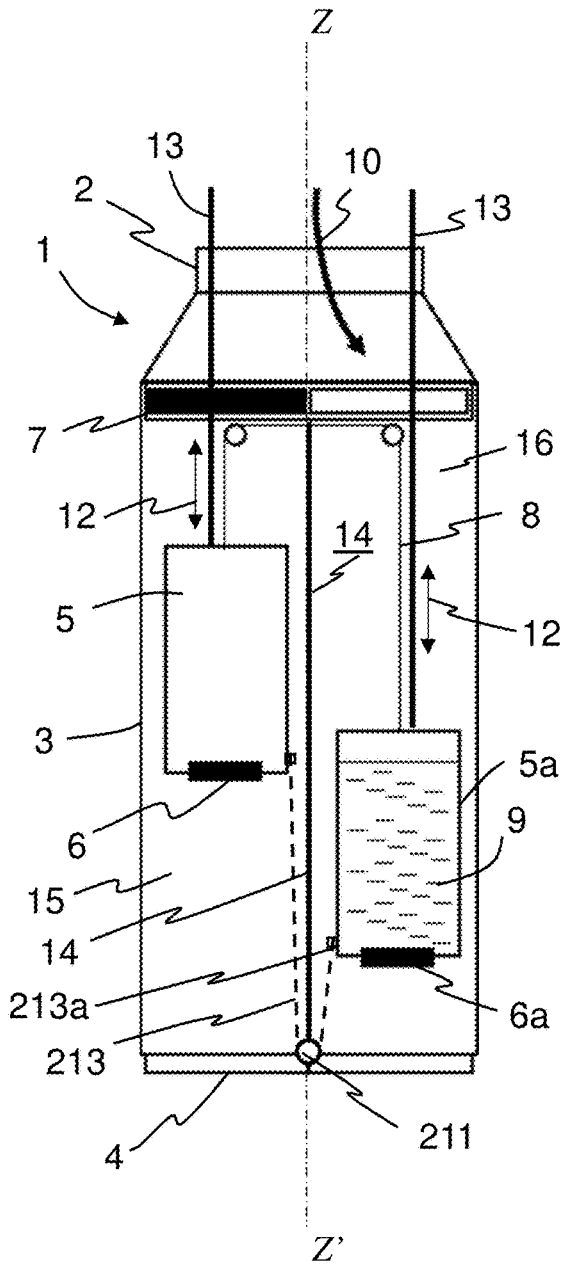
FIG. 1A-FIG. 1B. Schematic illustrations of examples of a motion device having two motion members each is positioned in a separate partition.

Following are more detailed descriptions of various concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

As used herein,

The term "gutter", "gutters", "rain gutter" or "rain gutters" refers to a system for discharging rain water from a roof of a house. It is typically installed at the lower edge of a roof so water from the roof can run into the rain gutter and be directed to specific points for discharging. A rain gutter is typically connected to one or more downspouts so rain water from the roof can be discharged through the downspouts to the ground.

The term "downspout" or "downspouts" refers to a hollowed piping system connected to a rain gutter to direct rain water from the rain gutter to the ground. Typically, a downspout can have an upper opening connected to a rain gutter and a lower opening near or at the ground forming a passage for discharging water.

The term "oscillating motions" refers to repeated motions around a central point or points that can comprise bi-directional motions or multi-directional motions. The term "oscillating motions" can also comprise reciprocating motions. The term "uni-directional motions" refers to motions in a certain direction. The uni-directional motions can comprise motions moving around in a circular fashion.

This invention is directed to a process for de-clogging a rain gutter and a downspout coupled to the rain gutter, the process comprising causing uni-directional motions or oscillating motions of a cleaning member of a cleaning device coupled to a set of motion connectors, the cleaning device is positioned within a portion of the rain gutter, the downspout or a combination thereof, wherein the uni-directional motions or oscillating motions are caused by manual operations, caused by directing a liquid from an upper opening of the downspout that is coupled to the rain gutter through the downspout to a motion device functionally coupled to the set of motion connectors, or a combination thereof, wherein the motion device is configured to drive the uni-directional motions or oscillating motions of the cleaning member based on motions of the liquid flowing through the downspout and through the motion device caused by gravity.

Suitable to the process of this invention, the uni-directional motions or oscillating motions are caused by a motion device. In examples of the process of this invention disclosed herein, a motion device can be configured to comprise:

a first motion member and a second motion member, wherein the first motion member and the second motion member are coupled together and each is further coupled to the set of motion connectors, the first motion member and the second motion member are configured to generate the oscillating motions based on the downward motion of the liquid through the downspout and through the motion device caused by gravity, and a device housing having an upper end and a lower end distal to each other along a longitudinal axis of the device housing, a partition member for forming a first partition and a second partition, each is parallel to the longitudinal axis, and a direction device for opening and closing the first partition and the second partition in alternate;

wherein, the first motion member is positioned in the first partition and the second motion member is positioned in the second partition, the first motion member and the second motion member are coupled together via a motion member coupler and each is movable parallel to the longitudinal axis, the first motion member is configured, when it moves downward, to pull the second motion member moving upward via the motion member coupler and, in alternate, the second motion member is configured, when it moves downward, to pull the first motion member moving upward via the motion member coupler; and wherein, the first partition and the second partition are positioned in the device housing; or the first partition is positioned in a first device housing and the second partition is positioned in a second device housing.

The motion device 1 disclosed hereafter and shown in FIG. 1A-1B, FIG. 2A-2D, FIG. 3A, FIG. 4, FIG. 6, FIG. 7 and other various figures with various configurations can be suitable. Some examples of a motion device and system installations are shown in FIG. 8A-8E. When installed, the motion device can be powered by a liquid, such as rain water 207 flowing into a rain gutter and a down flow water 207' flowing through a downspout (See at least FIG. 9, FIG. 10).

Figure 5:
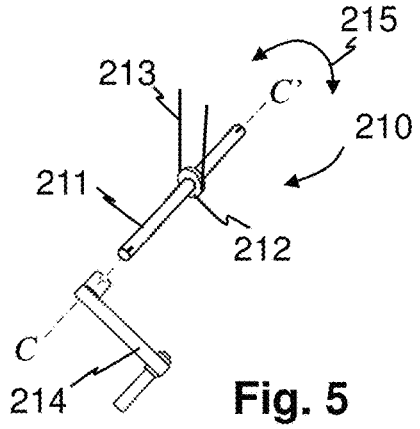
FIG. 5. An example of a cranking device with a crank handle.
Figure 11:
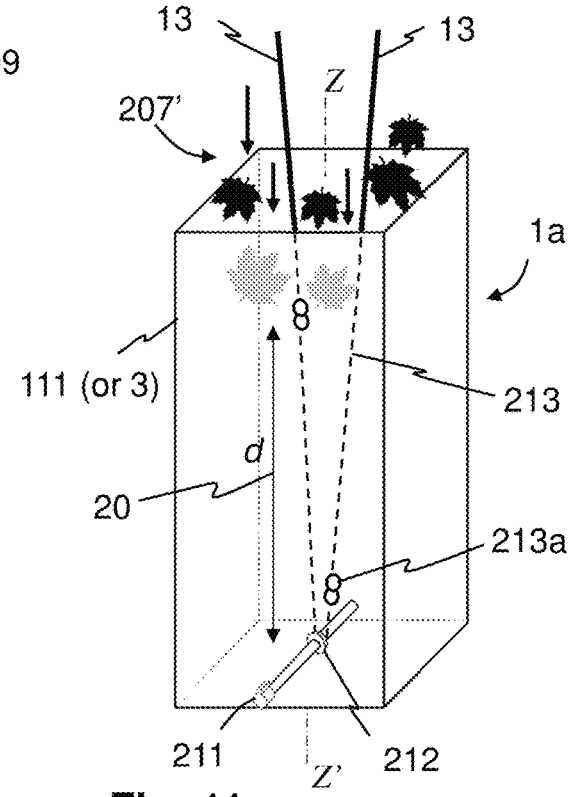
FIG. 11. An examples of a manual motion device having a crank with connections to a set of motion connectors.

Suitable to the process of this invention, the uni-directional motions or the oscillating motions can be configured to be caused by manual operation of a cranking device coupled to the set of motion connectors. A manual motion device 1*a* shown in FIG. 11 can be suitable. A cranking device 210 comprising a crank axle 211, a crank wheel 212, a crank connector 213 and a crank handle 214 can be suitable (FIG. 5). By cranking the crank handle 214 in one direction or back-and-forth in rotating directions 215 (FIG. 5), one can manually generate the uni-directional motions or oscillating motions. The oscillating motions can be repeated motions, such as back-and-forth motions, up-and-down motions, vibrating motions, or a combination thereof. The oscillating motions can also comprise reciprocating motions. The uni-directional motions can be motions in a certain direction. The uni-directional motions can be motions moving around in a circular fashion or a looping fashion. In examples, a cranking device 210 can be coupled directly to the cleaning member of the cleaning device via to the set of motion connectors 13 and crank connector 213 (FIG. 11), when assembled. In further examples, a cranking device 210 can comprise a set of connector linkers 213*a* to couple the crank connector 213 when assembled to form a manual motion device 1*a* (FIG. 11).

The process can comprise:

1) causing the first motion member to move downward when the first motion member is at the upper end and the second motion member is near the lower end by causing the direction device to open the first partition and close the second partition directing the liquid to accumulate in the first motion member forcing the first motion member to move downward and the second motion member to move upward;

2) allowing the accumulated liquid to exit through a first gate opening of the first motion member when the first motion member is at the lower end and the second motion member is at the upper end by triggering a first gating device of the first motion member to open;

3) causing the second motion member to move downward when the second motion member is at the upper end and the first motion member is at the lower end by causing the direction device to open the second partition and close the first partition, directing the liquid to accumulate in the second motion member forcing the second motion member to move downward and the first motion member to move upward;

4) allowing the accumulated liquid to exit through a second gate opening of the second motion member when the second motion member is at the lower end and the first motion member is at the upper end by triggering a second gating device of the second motion member to open; and 5) repeating steps 1)-5) generating the oscillating motions.

Figure 1B:
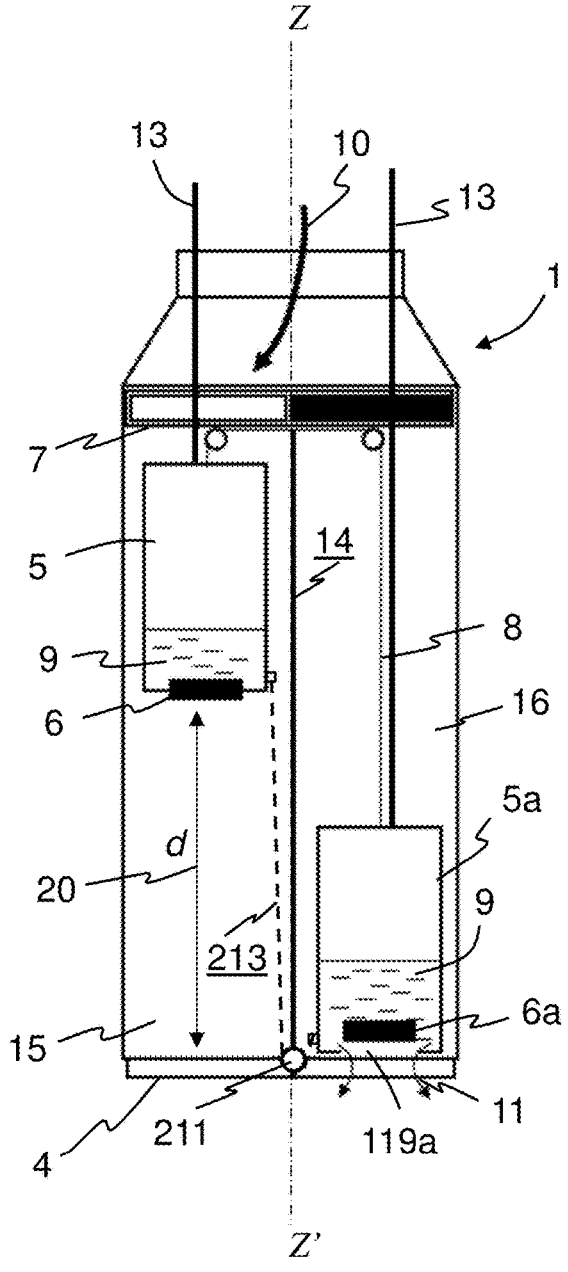

In examples, inflow liquid 10 can be directed to flow into a second motion member 5*a*, that can be a cup or a container, when the second partition 16 is opened by the direction device 7 (FIG. 1A). Accumulated liquid 9 in the second motion member causes the second motion member 5*a* to move downward (FIG. 1A). When the second motion member 5*a* reaches the lower end of the motion device, the second gating device 6*a* is then triggered to open allowing the accumulated liquid to exit the motion member 5*a* through the second gate opening 119*a* as outflow liquid 11 (FIG. 1B). At the same time, the direction device 7 closes the second partition 16 and opens the first partition 15 directing the inflow liquid 10 to flow into the first motion member 5, that is also a cup or a container. Detailed descriptions on the operation and examples of the configurations of the direction device 7 are provided hereafter and in various figures. Any of the direction devices of this invention disclosed hereabove and hereafter can be suitable. The motion members can be moving in motion directions 12 as indicated in FIG. 1A.

The process of this invention can further comprise:

providing a first retention device to hold the first motion member at the lower end and a second retention device to hold the second motion member at the lower end in alternate, wherein the first retention device is configured to release the first motion member from the lower end when a total weight of the second motion member is greater than a total weight of the first motion member by a pre-defined weight differential value causing the second motion member to move downward, and in alternate, the second retention device is configured to release the second motion member from the lower end when a total weight of the first motion member is greater than a total weight of the second motion member by the pre-defined weight differential value causing the first motion member to move downward.

In examples, the first retention device 120 and the second retention device 120*a* each can comprise a magnet affixed to the bottom of a respective motion member (FIG. 3A-FIG. 3E), and can interact with a retention device plate 130 that can comprise a metal net. The magnetic interaction can be configured to have an interaction force equal to or slightly less than the pre-defined weight differential value described above so when a weight difference between a total weight of the first motion member and a total weight of the second motion member reaches the pre-defined weight differential value, the first motion member can pull the second motion member moving upward away from the retention device plate 130. The pre-defined weight differential value can comprise a maximum difference between the total weights of motion members and resistance of the motion connectors that is a sum of weight, resistances and frictions of the motion connectors and pulleys.

In examples, a total weight of the first motion member is the sum of the weight of the first motion member and the weight of liquid that contains, such as water held in the first motion member. A total weight of the second motion member is the sum of the weight of the second motion member and the weight of the liquid such as water held in the second motion member. The resistance of the motion connectors can be measured, tested and adjusted once assembled.

Figure 15:
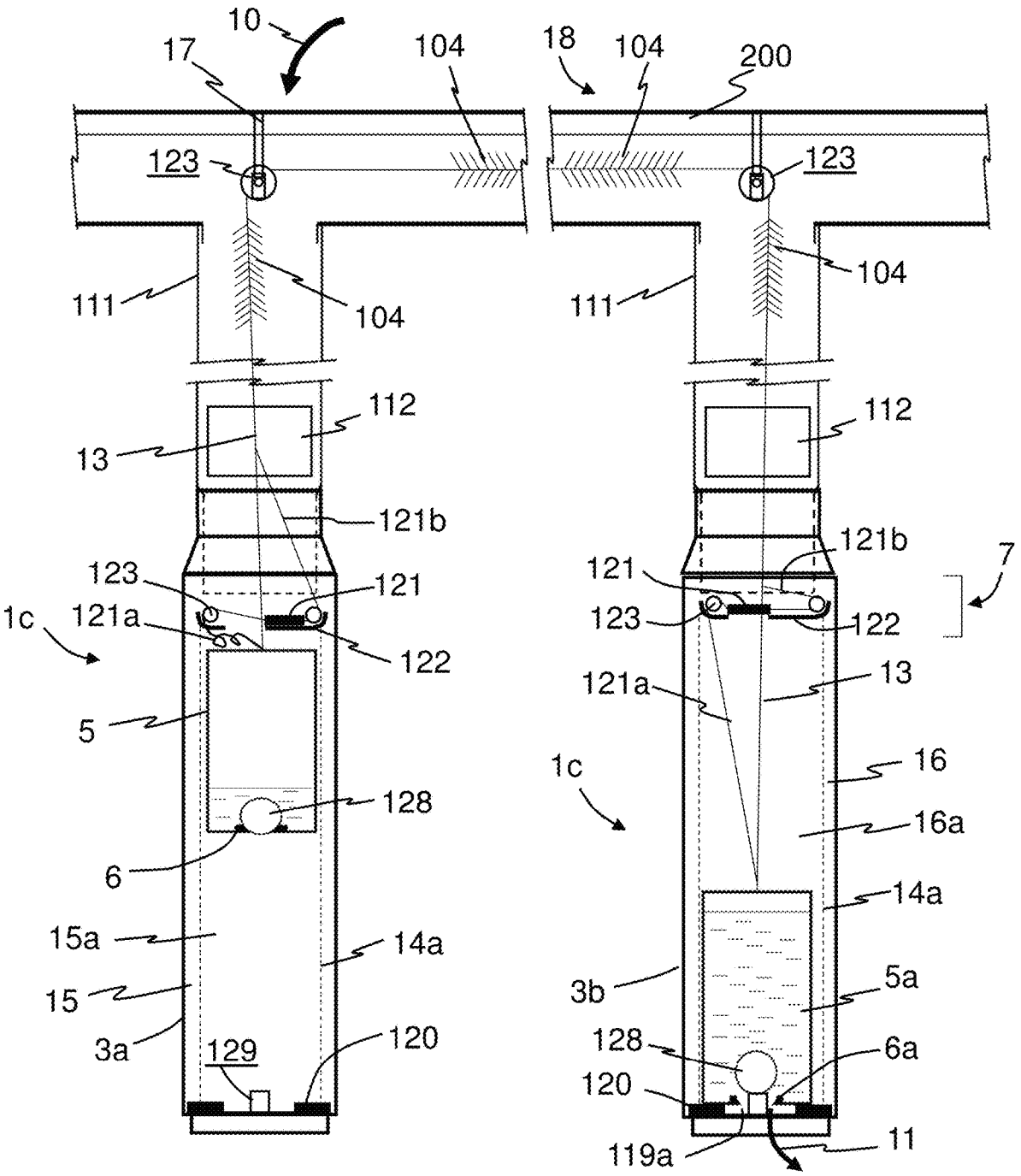
FIG. 15. A schematic illustration of an example of a configuration of a single driver motion device having the motion members positioned in two partitions in two separate downspouts. The illustration may not be to scale.

In another example of the process of this invention, the first motion member and the second motion member can be configured to be positioned in two separate downspouts in a pair of motion devices, wherein the cleaning member 104 can be positioned horizontally in a rain gutter connecting the two separate downspouts, in the downspout, or a combination thereof. One suitable example is a single driver motion device 1*c* comprising a pair of single motion member devices shown in FIG. 15. Examples of suitable cleaning device is also shown in FIG. 15.

In other examples of the process of this invention, the motion device can be configured to comprise:

a set of motion wheels coupled to the cleaning member of the cleaning device coupled to the set of motion connectors, wherein the motion wheels are configured to generate the uni-directional motions based on the downward motion of the liquid flowing through the downspout and through the motion device caused by gravity.

Figure 12:
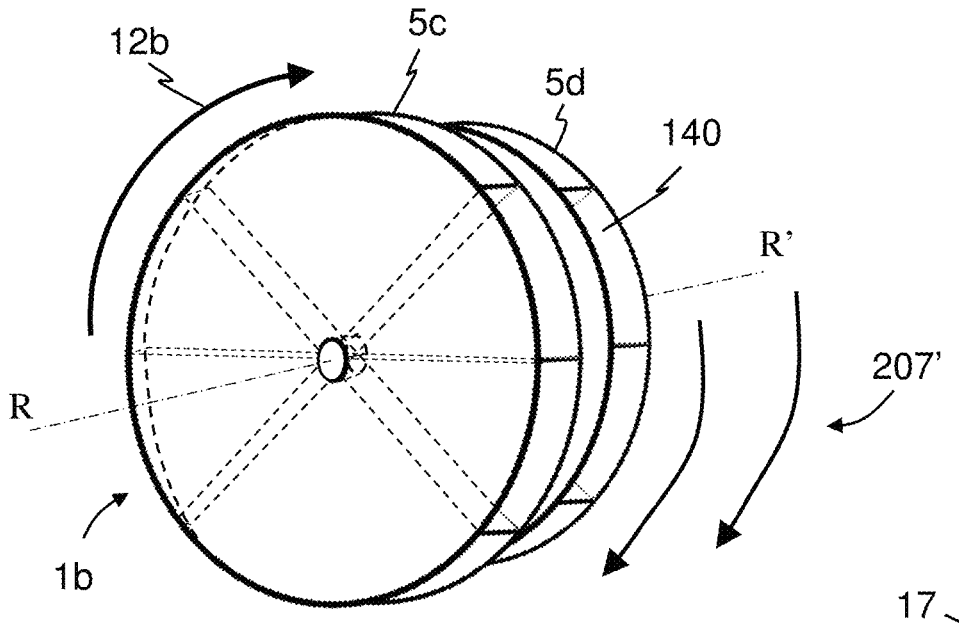
FIG. 12. A schematic illustration of a perspective view of a motion device comprising a set of motion wheels.
Figure 13:
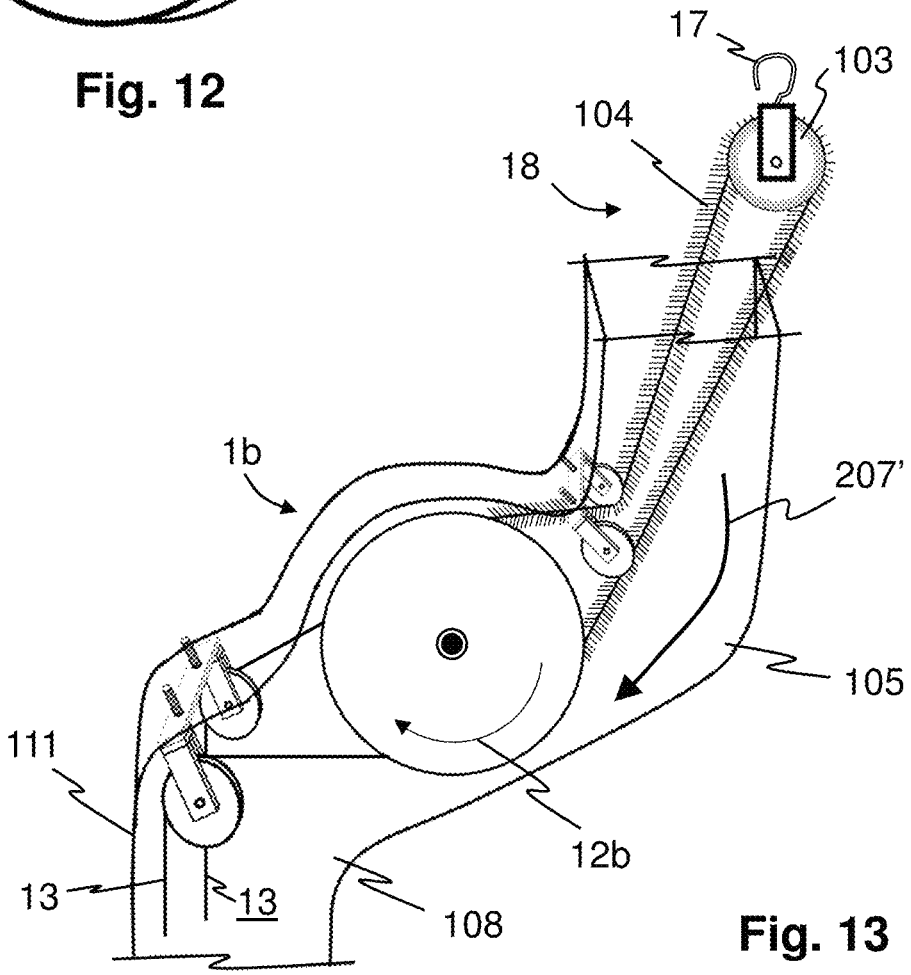
FIG. 13. A schematic illustration of a perspective view of a system installed having a motion device comprising a set of motion wheels. Optional motion connectors are shown.

The wheel motion device 1*b* shown in FIG. 12 and FIG. 13 can be suitable. The wheel motion device 1*b* can be configured so that water, such as down flowing water 207' can drive the set of motion wheels 5*c* and 5*d* to rotation alone its rotational axis R-R' causing the coupled cleaning device 18 to move and to loosen up any accumulated debris or to move the debris out of the rain gutter 200. As described hereafter, the set of motion wheels 5*c* and 5*d* can be configured to have rain water flowing at its lower side to spin the motion wheels in the spinning direction 12*b* (FIG. 12 and FIG. 13).

In examples, a crank connector 213 can be, optionally, directly connected to the set of motion connectors 13 that is connected to the motion wheels of a wheel motion device 1*b* that is further connected to the cleaning member 104 (FIG. 13).

The process can be automatically repeated when the liquid is flowing downward through the downspout. In examples, the liquid can comprise rain water. In additional examples, the liquid can comprise rain water collected by the rain gutter and directed to the upper opening of the downspout to flow downward through the downspout.

In another example, the liquid can be water supplied from a water source, such as a water hose connected to a water supply. The water can be supplied from a water source and directed to the upper opening of the downspout to flow downward through the downspout.

In the process of this invention, the cleaning member can be configured to move in a first direction when the first motion member is moving downward, and in alternate, the cleaning member can be configured to move in a second direction that is opposite to the first direction, when the second motion member is moving downward.

Suitable to the process of this invention, a cleaning device can be configured to be positioned within the rain gutter through the upper opening of the downspout, in a downspout, or a combination thereof. The cleaning device 18 shown in FIG. 8B, FIG. 8D-8E, FIG. 9, FIG. 13, FIG. 15 and described herein can be suitable.

This invention is further directed to a system for declogging a rain gutter and a downspout coupled to the rain gutter, the system comprising:

a motion device and a cleaning device comprising a cleaning member functionally coupled to the motion device, wherein the motion device is configured to drive uni-directional motions or oscillating motions of the cleaning member based on motions of a liquid flowing through the downspout and through the motion device caused by gravity.

The motion device can comprise:

a device housing 3 having an upper end 2 and a lower end 4 distal to each other along a longitudinal axis (Z-Z') of the device housing 3, a partition member 14 for forming a first partition 15 and a second partition 16, each is parallel to the longitudinal axis, and a direction device 7 for opening and closing the first partition and the second partition in alternate; and a first motion member 5 positioned in the first partition 15 and a second motion member 5*a* positioned in the second partition 16, the first motion member and the second motion member are coupled together via a motion member coupler 8 and each is movable parallel to the longitudinal axis (Z-Z'), the first motion member 5 is configured, when it moves downward, to pull the second motion member 5*a* moving upward via the motion member coupler 8 and, in alternate, the second motion member 5*a* is configured, when it moves downward, to pull the first motion member 5 moving upward via the motion member coupler 8;

wherein, the first partition and the second partition are positioned in the device housing; or the first partition is positioned in a first device housing and the second partition is positioned in a second device housing.

In one embodiment, the motion device 1 disclosed herein and shown in various figures including FIG. 1A-1B, FIG. 2A-2D, FIG. 3A-3E, FIG. 4-FIG. 7 and other figures can be suitable. In another example, the motion device can further comprise a cranking device coupled to the first motion member and the second motion member configured for moving the first motion member and the second motion member to generate the oscillating motions (such as shown in FIG. 1A-1B, FIG. 2A-2B and FIG. 4) or coupled directly to the set of motion connectors configured to generate the oscillating motions (such as the manual motion device 1*a* shown in FIG. 11). In yet another example, the single driver motion device 1*c* comprising a pair of single motion member devices shown in FIG. 15 and described herein can be suitable.

The cleaning device can comprise:

a set of motion connectors 13 coupled to the cleaning member 104, wherein the set of motion connectors 13 is further connected to the first motion member 5 and the second motion member 5*a;* wherein, the direction device 7 is configured to open the first partition 15 and close the second partition 16 when the first motion member 5 is near the upper end 2 and the second motion member 5*a* is near the lower end 4, in alternate, the direction device 7 is configured to open the second partition 16 and close the first partition 15 when the second motion member 5*a* is near the upper end 2 and the first motion member 5 is near the lower end 4, and the direction device 7 is configured to open only one of the first and the second partition at a time; and wherein the cleaning member 104 are configured to have oscillating motions (shown as oscillating directions 12*a* in FIG. 8B) moving in a first direction when the first motion member is moving downward, and in alternate, the cleaning member is moving in a second direction that is opposite to the first direction, when the second motion member is moving downward.

The cleaning device 18 shown in FIG. 8B, FIG. 8D-8E, FIG. 9, FIG. 13, FIG. 15 and described herein can be suitable.

Some of representative examples of a motion device are shown schematically in FIG. 1A-FIG. 2D. A combination of any of the examples can be suitable. It is understood that not all elements, parts or features are shown in all figures. Also, for simplicity reasons, some parts, elements or features labeled in one figure may not be labelled in other figures. Although a motion device can be shown in drawings or descriptions as being installed in a section of a downspout or as a stand-alone device with a stand-alone device housing, any of the motion devices of this invention can be installed either in a section of a downspout or a stand-alone device housing.

The first motion member 5 and the second motion member 5*a* each can have a volume capacity in a range of from 100 mL to about 1,000 mL that can produce a motion force in a range of from 100 grams to about 1,000 grams. This motion force can cause the cleaning member to have the oscillating motions even if some debris, such as leaves have already partially clogged the rain gutter or the downspout. For a raining season that often rains, the rain gutter and the downspout can be cleaned frequently whenever it rains. If debris accumulation caused the downspout partially clogged, the cranking device can be used to produce a larger motion force to loosen up the partially clogged debris. A motion device having a cranking device, such as the manual motion device 1*a* can be suitable (FIG. 11).

The cleaning device 18 can further comprise a gutter connecter 17 (FIG. 8B, FIG. 8D, FIG. 8E, FIG. 13 and FIG. 15) connected to a cleaning pulley 103 (or combined with the coupling pulleys 123 in FIG. 15). In examples, a cleaning device 18 can be positioned by connecting the gutter connecter 17 to a gutter hanger 100 (FIG. 8A-FIG. 8B).

Figure 8A:
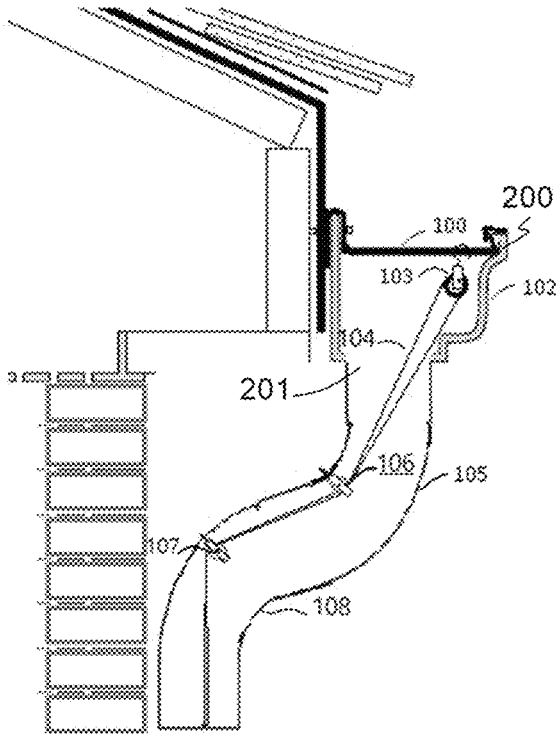
FIG. 8A-FIG. 8E. Schematic illustrations of examples of a cleaning device and a set of routing devices.
Figure 8B:
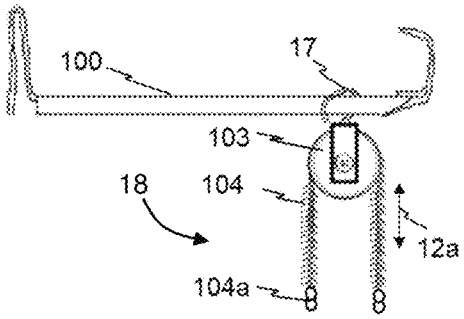
Figure 8C:
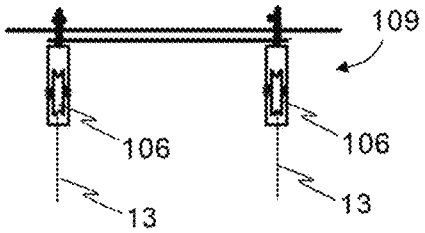
Figure 8D:
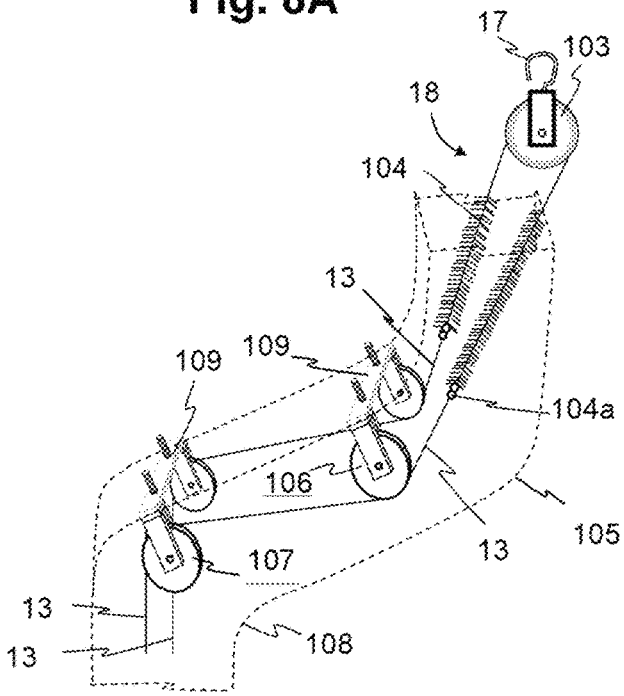
Figure 8E:
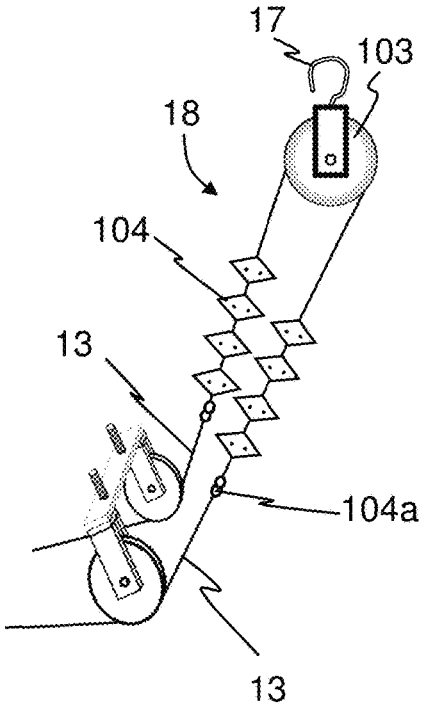
Figure 9:
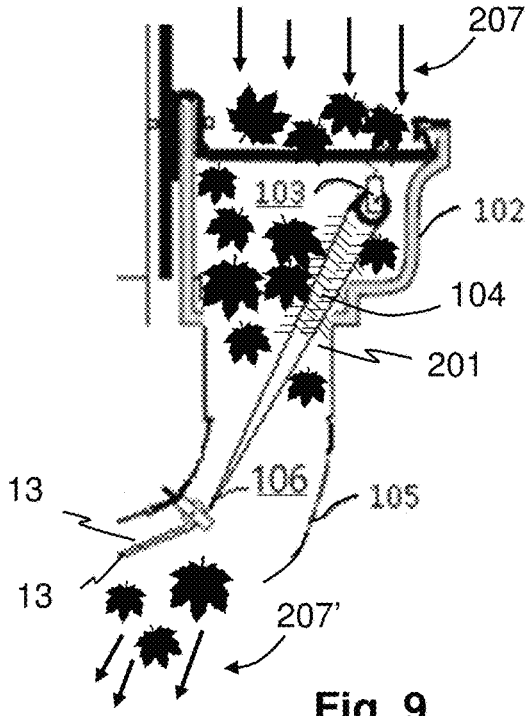
FIG. 9. A schematic illustration of a side cross sectional view of an example of a cleaning device installed in a rain gutter. Items shown may not be to scale.
Figure 14:
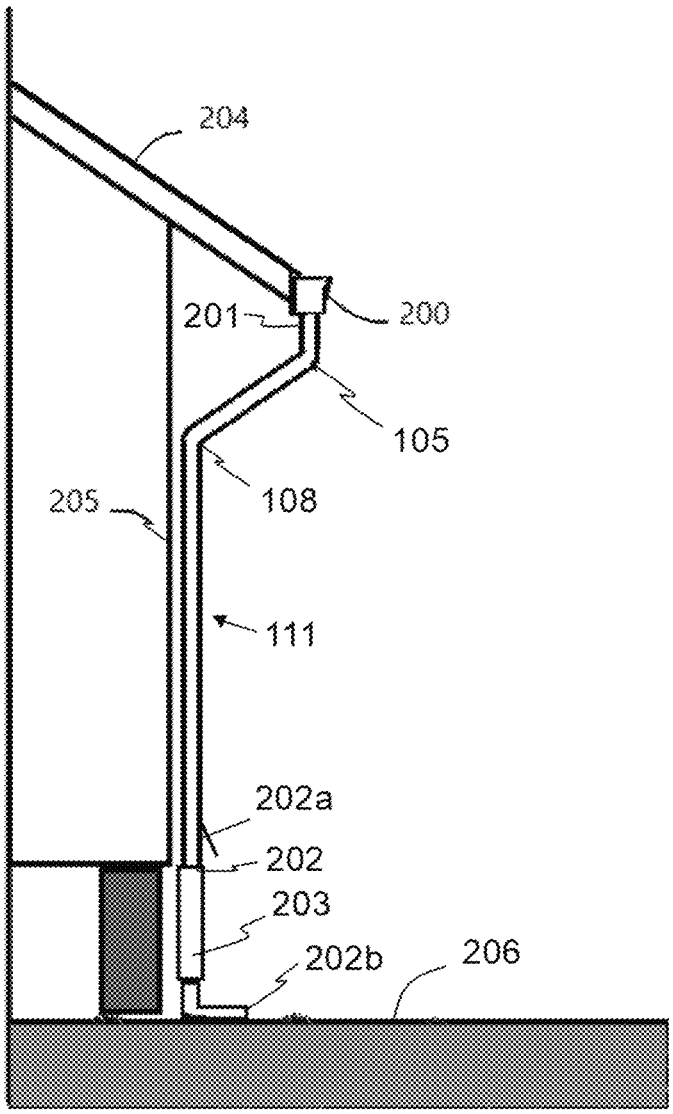
FIG. 14. An example of a rain gutter and downspout system installed on the side of a house.

The downspout 111 can have an upper opening 201 and a lower opening 202 distal to each other, the upper opening 201 can be coupled to a rain gutter 200 (FIG. 8A, FIG. 9 and FIG. 14). The cleaning device 18 can be configured to be positioned within the rain gutter side wall 102 through the upper opening 201 of the downspout (FIG. 8A and FIG. 9). A motion device can be configured to be positioned at the lower opening 202 of the downspout, and the cleaning member 104 of the cleaning device 18 and the motion device are connected through a set of motion connectors 13 via a set of optional cleaning connectors 104*a* (FIG. 8B, FIG. 8D and FIG. 8E).

The cleaning member 104 can comprise up-directional bristles, down-directional bristles, soft sticks, hard sticks, paddles, clips, and so on, or a combination thereof (FIG. 8B, FIG. 8D, FIG. 8E, FIG. 9, FIG. 13 and FIG. 15). The cleaning member 104 can also be in different shapes, such triangle, square, circular, polygon, flower shape, or other suitable shapes. The cleaning member 104 can also have sharp edges, zig-zag edge, a saw shaped edge, or a combination thereof. The cleaning device can also comprise clips or shredding blades as shown in FIG. 8E. The cleaning member can be made from metal, soft or flexible plastics, rigid plastics, or a combination thereof. The cleaning member can also be installed in the rain gutter 200, inside a downspout 111, at the first elbow 105 or the second elbow 108.

Figure 7:
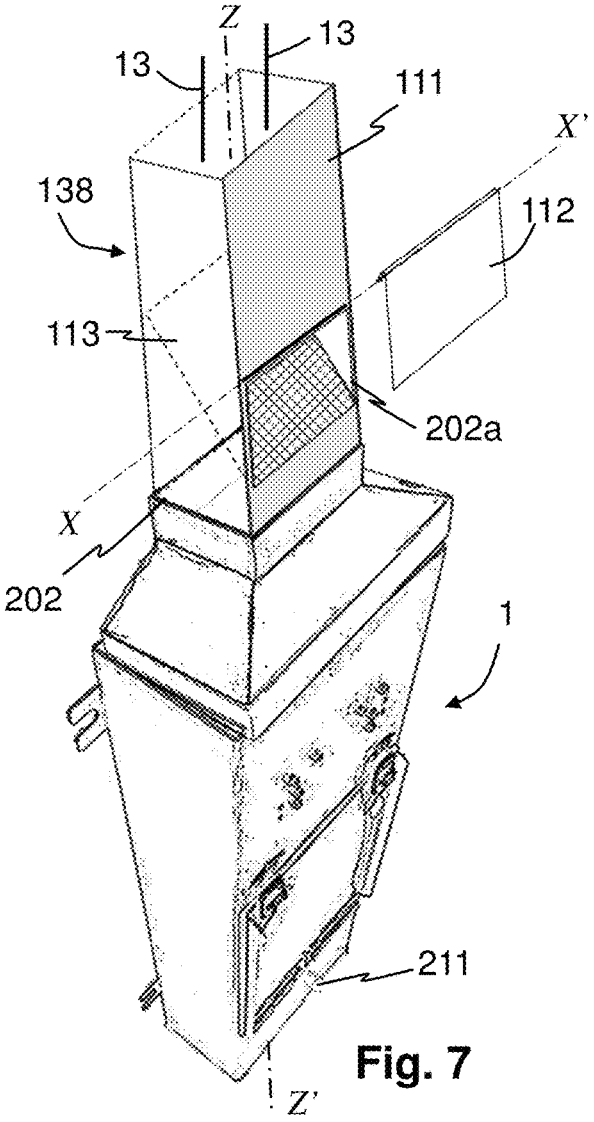
FIG. 7. A perspective view of an example of an assembled motion device and a debris removal assembly.
Figure 10:
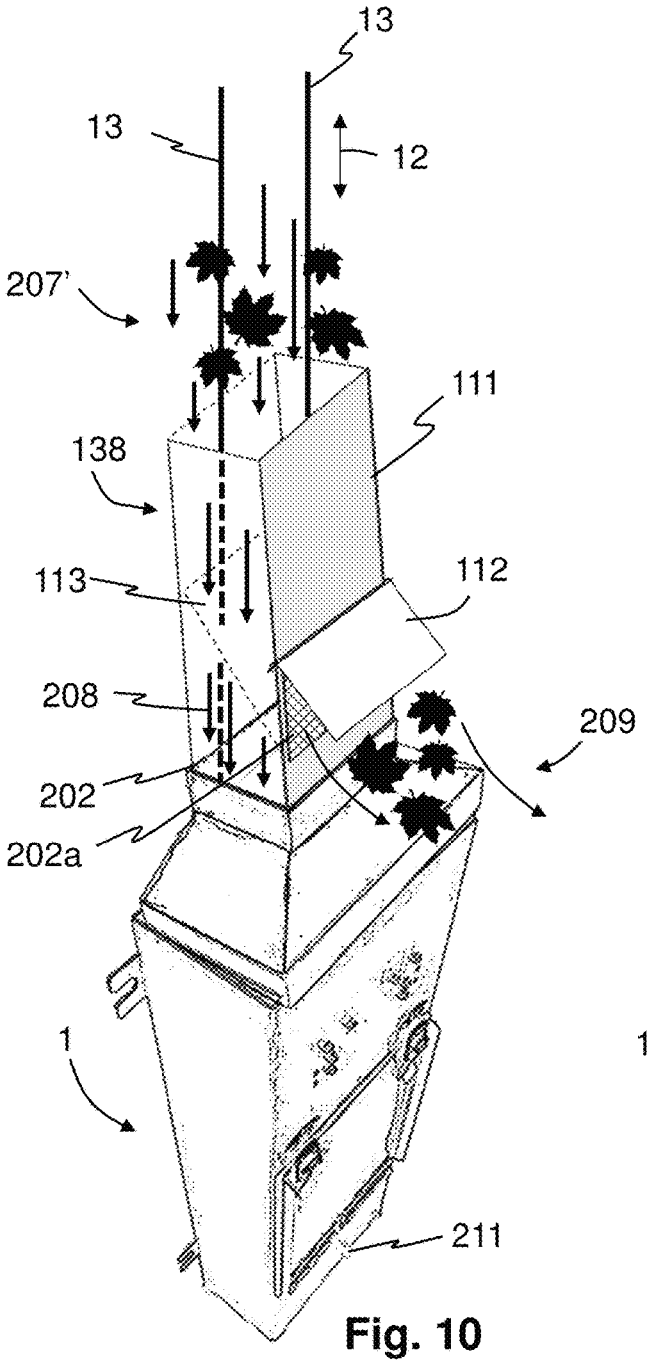

The system of this invention can further comprise one or more routing devices 109 for routing the set of motion connectors 13 through the downspout; and a debris removal device 113 and debris exit 202*a*, the debris removal device and the debris exit are coupled together and both are positioned at the lower opening 202 of the downspout 111 and above the motion device (such as the motion device 1 and single driver motion device 1*c*) (FIG. 7, FIG. 10 and FIG. 15).

The routing device 109 can be especially useful for routing the set of motion connectors 13 through one or more elbows of a downspout, such as a first elbow 105 and a second elbow 108. A routing device 109 can comprise a pair of routing pulleys 106 and can be coupled to the set of motion connectors 13 when assembled (FIG. 8A-FIG. 8E).

Figure 2A:
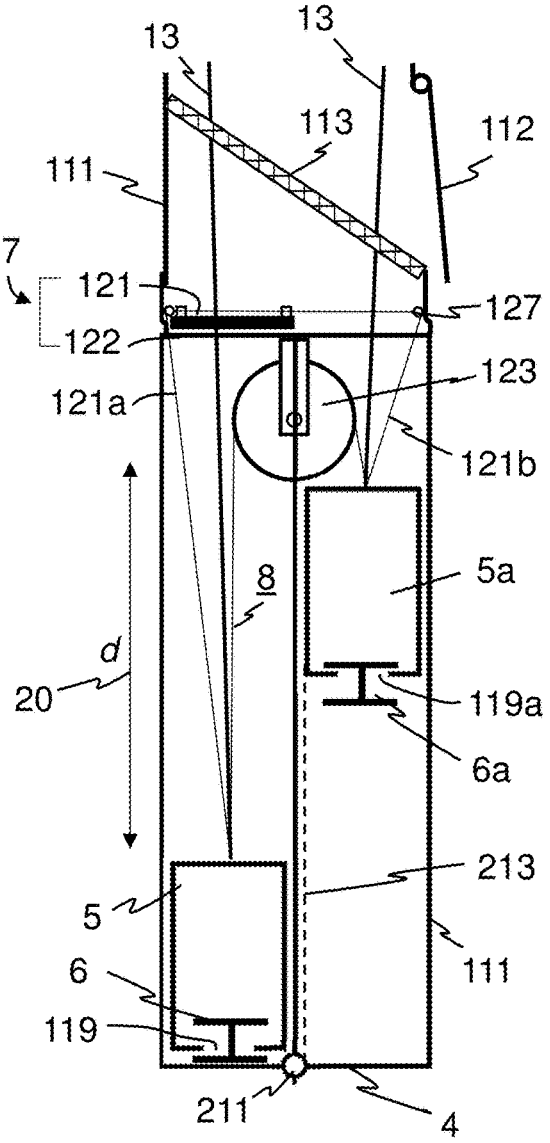
FIG. 2A-FIG. 2D. Cross-sectional side views of schematic illustrations of examples of variations of motion devices.

The traveling distance of the motions of the cleaning member 104 can be controlled by a motion distance d 20 that is a distance traveled by the first and the second motion members, a pre-defined travel length of the motion member coupler 8, a pre-defined travel length of crank connector 213, or a combination thereof (See at least FIG. 1B, FIG. 2A and FIG. 11).

The first motion member 5 can further comprise a first gating device 6 at the bottom of the first motion member coupled to a first gate opening 119 that is configured to be open when the first motion member is at the lower end and to be closed when the first motion member leaves the lower end, the second motion member 5*a* can further comprise a second gating device 6*a* member coupled to a second gate opening 119*a* at the bottom of the second motion member that is configured to be open when the second motion member is at the lower end and to be closed when the second motion member leaves the lower end (See at least FIG. 1B and FIG. 2A).

The system of this invention can further comprise a first retention device 120 to hold the first motion member at the lower end and a second retention device 120*a* to hold the second motion member at the lower end in alternate, wherein the first retention device 120 is configured to release the first motion member 5 from the lower end when a total weight of the second motion member 5*a* is greater than a total weight of the first motion member 5 by a pre-defined weight differential value causing the second motion member 5*a* to move downward, and in alternate, the second retention device 120*a* is configured to release the second motion member 5*a* from the lower end 4 when a total weight of the first motion member 5 is greater than a total weight of the second motion member 5*a* by the pre-defined weight differential value causing the first motion member to move downward (FIG. 1A-1B, FIG. 2A-2D and FIG. 3A).

In examples, a total weight of the first motion member is the sum of the weight of the first motion member and the weight of water held in the first motion member. A total weight of the second motion member is the sum of the weight of the second motion member and the weight of water held in the second motion member.

The partition member 14 can be configured to support a direction device 7, a direction plate 121, a direction support 122, one or more coupling pulleys 123, a set of direction pulley 127, a gating device trigger 129 and a retention device plate 130 (see at least FIG. 1A-FIG. 2D, FIG. 3A, FIG. 3D, FIG. 3E and FIG. 4).

The debris removal device 113 and debris exit 202*a*, the debris removal device and the debris exit can be coupled together and both are positioned at the lower opening 202 of the downspout 111 and above the motion device 1 or 1*c*, when assembled (FIG. 3A, FIG. 3B, FIG. 7, FIG. 10 and FIG. 15). The debris exit 202*a* can be comprise an exit door 112 (FIG. 3A, FIG. 7, FIG. 10 and FIG. 15) that can be configured openable by rotating around a door rotational axis X-X' that is perpendicular to the longitudinal axis Z-Z' and parallel to a plain of the debris exit 202*a* (FIG. 7). The exit door 112 can be opened by a flow of water from inside of the downspout flowing out of the debris exit while be closed if pushed from outside. In one example, the debris removal device is a screen that can be installed in a section of a downspout above the motion device. The debris removal device, such as a screen can be positioned so that outflow debris 209, such as large objects, such as leaves can be blocked and forced to move out of the downspout through the debris exit 202*a*, while the water 208 without debris can flow through the screen exiting the downspout and flowing into a coupled motion device 1 (FIG. 10) or single driver motion device 1*c* (FIG. 15).

Figure 2B:
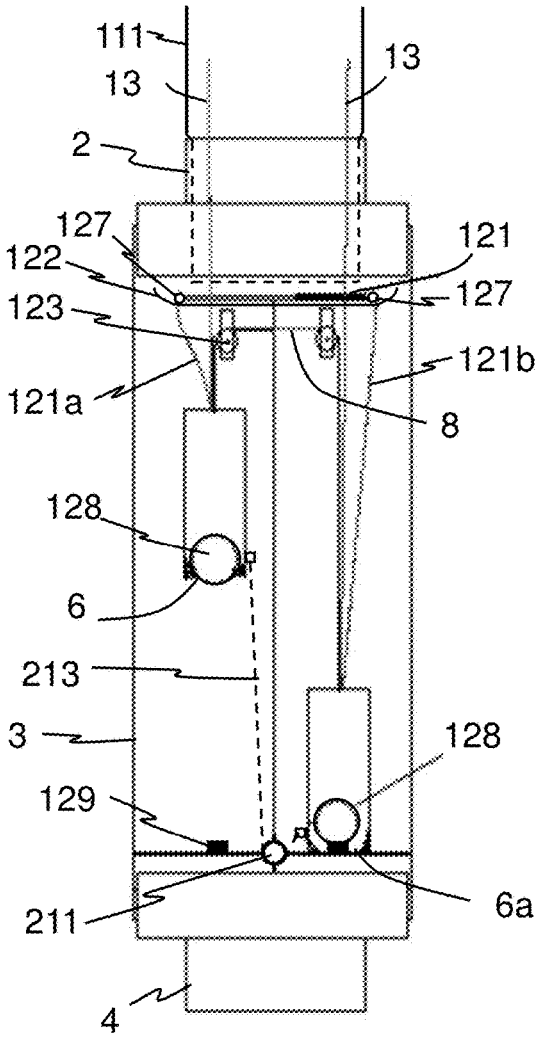
Figure 2C:
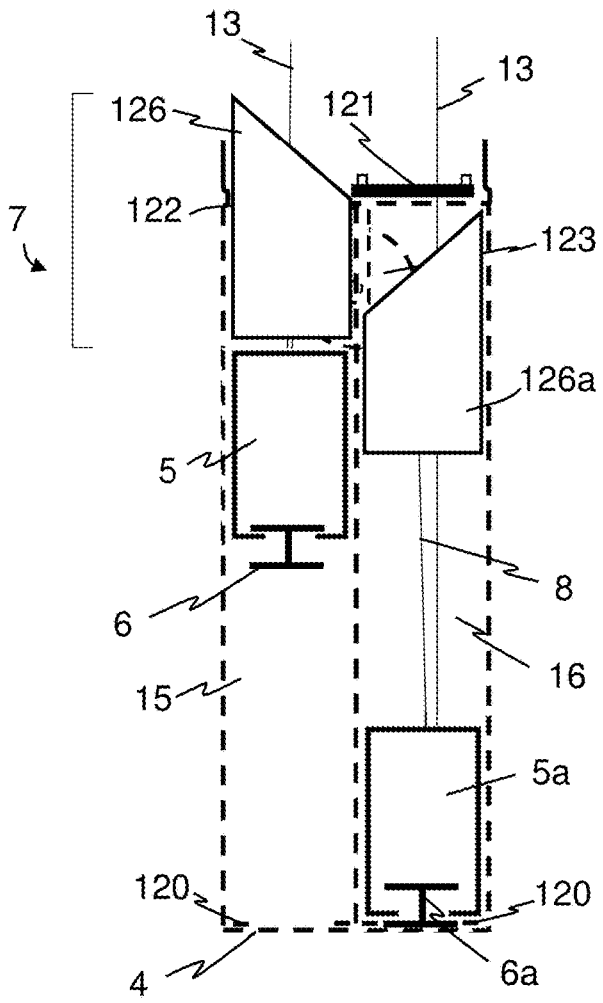
Figure 2D:
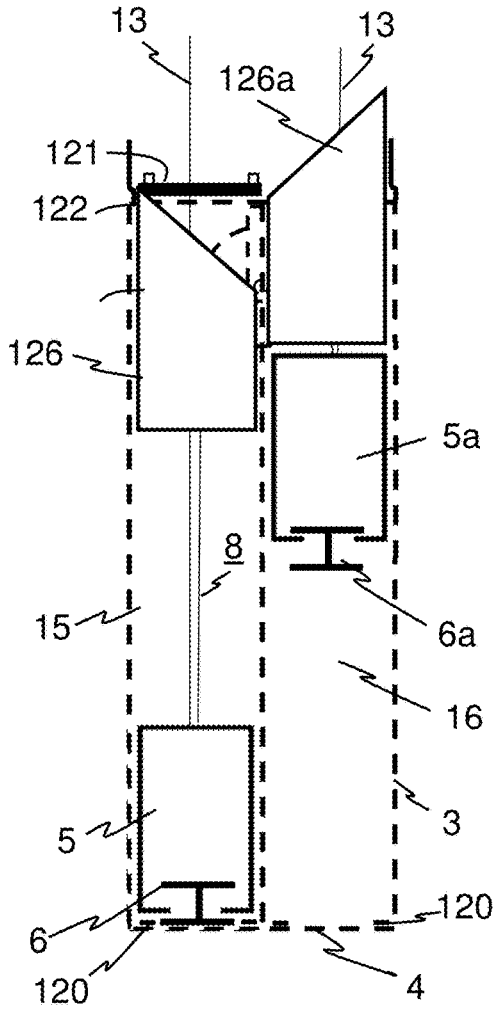

Examples of a direction device 7 are shown in FIG. 1A-1B, FIG. 2A-2D, FIG. 3A, FIG. 3C, FIG. 4 and FIG. 15. The direction device 7 can comprise a direction plate 121, a direction support 122 and a direction coupler (FIG. 2A, FIG. 2B, FIG. 3A and FIG. 3C). The direction coupler can be selected from at least one trapezoid frame 126, a set of direction connecters 121*a* and 121*b*, or a combination thereof. In examples, the direction coupler can comprise a pair of trapezoid frames 126 and 126*a* positioned inside a motion device 1 (FIG. 2C-2D and FIG. 3A), wherein the first motion member can be configured to move upward and push a first trapezoid frame 126 sliding the direction plate 121 to close the second partition 16 and open the first partition 15, and in alternate, the second motion member 5*a* can be configured to move upward and push a second trapezoid frame 126*a* sliding the direction plate 121 to close the first partition and open the second partition 16 (FIG. 2C-2D). In other examples, the direction coupler can comprise a set of direction connecters 121*a* and 121*b* (FIG. 2A and FIG. 2B) connected to the direction plate 121, wherein the first motion member 5 can be configured to pull the direction connector 121*a* sliding the direction plate 121 to close the first partition and open the second partition when the first motion member is at the lower end 4 (FIG. 2A). In alternate, the second motion member 5*a* can be configured to pull the direction connector 121*b* sliding the direction plate 121 to close the second partition and open the first partition when the second motion member 5*a* is at the lower end 4 (FIG. 2B). A direction support 122 can be positioned to support the direction plate 121 and can be affixed to a side of the device housing 3 of the motion device, affixed to the partition member 14, or a combination thereof (FIG. 2B). The direction support 122 can be configured to have a funnel shape to facilitate the collection of water (See at least FIG. 2B). This can be important when rain is light and the amount of water flowing through the downspout is at the minimum, wherein the funnel shaped direction support can maximize the collection of the rain water to flow into the motion members. In further examples, a direction coupler can comprise a set of direction connecters 121*a* and 121*b* and a first trapezoid frame 126 positioned inside the motion device 1, wherein the first motion member 5 can be configured to move upward and push the first trapezoid frame 126 sliding the direction plate 121 to close the second partition and open the first partition (FIG. 2C) and, in alternate, the first motion member 5 can be configured to move downward pulling the direction connecters 121*a* causing the direction plate 121 to open the second partition and close the first partition, and to push the first trapezoid frame 126 downward (FIG. 2D). The direction plate 121 can be moving back and forth based on the motions of the motion members. Same configuration can be used for the second trapezoid frame 126*a* and the second motion member 5*a*.

Figure 3A:
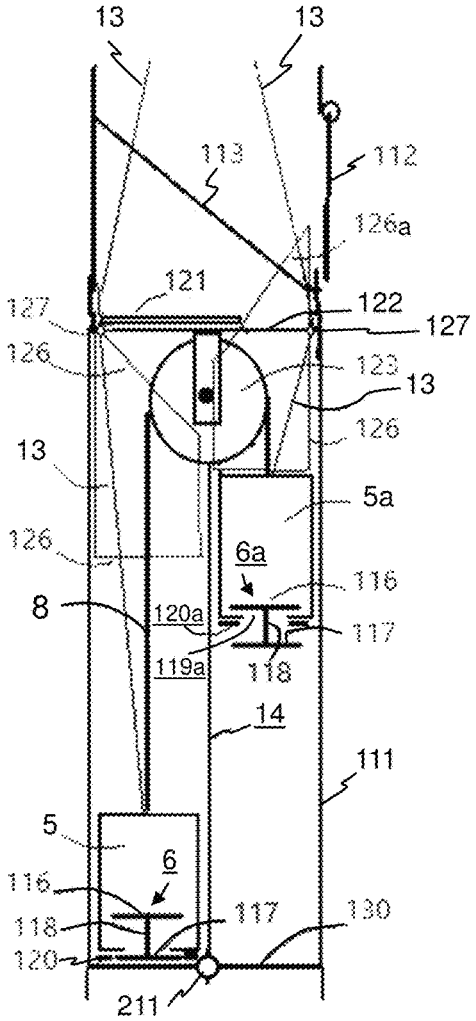
FIG. 3A-FIG. 3E. Schematic illustrations of examples of a motion device and its parts.
Figure 3B:
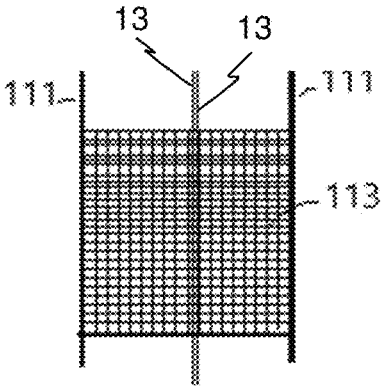
Figure 3C:
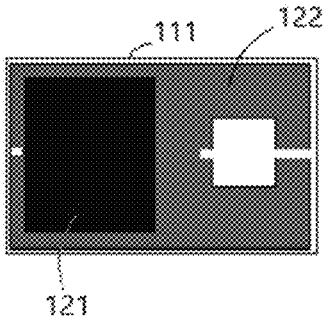
Figure 3D:
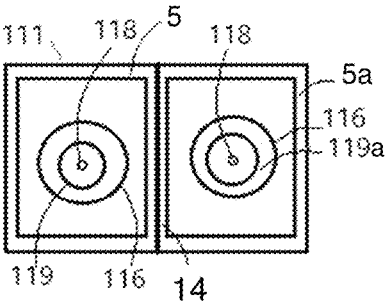
Figure 3E:
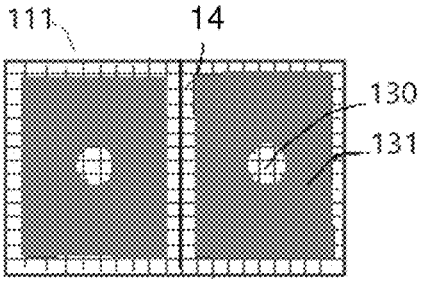
Figure 4:
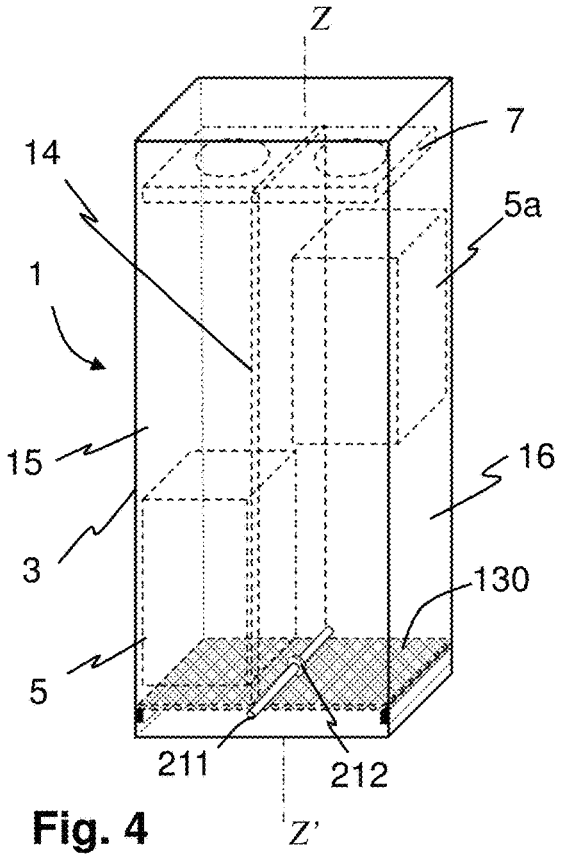
FIG. 4. A schematic illustration of a transparent perspective view of an example of a motion device having two motion members and two partitions.

A top-down view of one representative example of a direction plate 121 and a direction support 122 is shown in FIG. 3C. A top-down cross-sectional view of one representative example of a first motion member 5 and second motion member 5*a* is shown in FIG. 3D. In one example, a first gating device 6 and a second gating device 6*a* each can comprise a piston 116 coupled to a connection rod 118 and a second rod 117 configured to seal the first gate opening 119 and second gate opening 119*a*, respectively, at a closed position, or to keep the gate openings open at an open position as disclosed herein. In another example, a first gating device 6 and a second gating device 6*a* each can comprise a ball valve member 128. The motion device 1 or motion device 1*c* each can comprise a matching gating device trigger 129 affixed to the bottom of the motion device aligned with the ball valve member 128 so configured that when a motion member is at the lower end 4, the gating device trigger 129 pushes the ball valve member upward opening the gate opening 119 or 119*a* (FIG. 2B and FIG. 15). When the motion member leaves the lower end, the ball valve member 128 gets seated and closes the gate opening.

The system of this invention can further comprise a retention device plate 130 (See at least in FIG. 3A and FIG. 3E) that can interact with the first retention device 120 to hold the first motion member at the lower end and, in alternate, the second retention device 120*a* to hold the second motion member at the lower end. In examples, the first retention device 120 and the second retention device 120*a* each can comprise a magnet affixed to the bottom of a respective motion member (FIG. 3A), and the retention device plate 130 can comprise a metal net that can have magnetic interaction with the first retention device 120 and the second retention device 120*a* so when a motion member is positioned near the retention device plate 130, that retention member can be held by the magnetic force to stay on the retention device plate 130. In another example, the retention device plate 130 can comprise an additional magnetic plate 131 affixed to the retention device plate 130 and is configured to have an opposite magnetic polarity towards the first retention device 120 and the second retention device 120*a* so that the additional magnetic plate 131 and the first retention device 120 and the second retention device 120*a* can attract to each other and to hold the motion member in place at the retention device plate 130. The magnetic interaction can be configured to have an interaction force equal to the pre-defined weight differential value described above so when a weight difference between a total weight of the first motion member and a total weight of the second motion member reaches the pre-defined weight differential value, the first motion member can pull the second motion member moving upward away from the retention device plate 130. In other examples, the retention device can comprise friction devices, such as pairs of clamps and inserts installed on the motion members and, for example, the retention device plate, so when a motion member is at the retention device plate, the inserts and the clamps can interact to hole the motion member at the retention device plate. When the pre-defined weight differential value is reached, the interaction between the inserts and the clamps can break resulting in the release of the motion member. Although the inserts, the clamps and the retention device plate are specifically mentioned, the friction devices can be any other types and can be installed at any other locations.

Suitable to the system of this invention, the motion device can further comprise a cranking device 210. The cranking device 210 can comprise a crank axle 211, a crank wheel 212, a crank connector 213 and an optional crank handle 214. Some of examples of components are shown in FIG. 5. The crank axle 211 and the crank wheel 212 can be installed at the bottom of a motion device or in a section of a downspout, such as shown in FIG. 1A-1B, FIG. 2A-2B, FIG. 3A, FIG. 4, FIG. 6, FIG. 7, FIG. 10, FIG. 11 and FIG. 16B.

In examples, the cranking device 210 can be coupled to the first motion member 5 and the second motion member 5*a* configured for moving the first motion member and the second motion member to generate the oscillating motions or coupled directly to the set of motion connectors configured to generate the oscillating motions. The cranking device 210 can comprise a set of connector linkers 213*a* to couple the motion members and the motion connector 13. In one example, the crank axle 211 can be positioned at the lower end of the device housing 3 between the first partition and the second partition perpendicular to the longitudinal axis Z-Z' and parallel to the partition member 14, the crank wheel 212 can be co-axially affixed in a mid-section of the crank axle 211 and functionally coupled to the crank connector 213 when assembled. The crank connector 213 can have one end affixed to the first motion member 5 and a second end affixed to the second motion member 5*a*. The crank handle can be operated to cause the crank axle to turn in directions shown in rotating directions 215 (FIG. 5). The cranking device is configured that when the crank axle is turned in a first direction alone a rotational axis C-C' (FIG. 5), the crank wheel moves the crank connector 213 causing the first motion member 5 to move downward and at the same time causing the second motion member 5*a* to move upward. When the crank axle is turned in a second direction, the crank wheel moves the crank connector causing the first motion member to move upward and at the same time causing the second motion member to move downward. By turning the crank axle in the first and the second directions repeatedly, shown as the rotating directions 215, the motion device can generate oscillating motions of a cleaning device when such cleaning device is coupled to the motion device. Some representative examples are shown in schematic illustrations in FIG. 1A-1B, FIG. 2A-2B, FIG. 4, FIG. 6, FIG. 7 and FIG. 10.

In other examples, the cranking device can be coupled directly to the cleaning device a manual motion device 1*a*. One representative example is shown in FIG. 11, wherein the crank connector 213 can be directly connected to the set of motion connectors 13 that is further connected to the cleaning member 104, when assembled. The cranking device 210 can comprise a set of connector linkers 213*a* to couple the crank connector 213 (FIG. 11) when assembled. Cranking the crank handle 214 back-and-forth in rotating directions 215 (FIG. 5) can generate the oscillating motions of a cleaning device. The cranking device 210 can be assembled within a section of a downspout 111 or a device housing 3 of a motion device (FIG. 11). In one example, a manual motion device 1*a* can replace the motion device 1 in FIG. 10 to form a manual system of this invention. Such manual system can also comprise the debris removal device 113, the debris exit 202*a* and the exit door 112.

A motion device comprising a set of motion wheels can also be suitable for the system of this invention, wherein the motion device comprises:

a set of motion wheels coupled to a cleaning member of a cleaning device, wherein the motion wheels are configured to generate a motion based on the downward motion of a liquid flowing through a downspout and through the motion device caused by gravity or based on manual operations of a cranking device coupled to the motion wheels.

In examples, the motion wheels are configured to generate a motion based on the downward motion of a liquid flowing through a downspout and through the motion device caused by gravity. In other examples, the motion wheels are configured to generate a motion based on manual operations of a cranking device coupled to the motion wheels.

The wheel motion device 1*b* shown in FIG. 12 and FIG. 13 can be suitable. The motion device can be configured so that water, such as down flow water 207' can drive the motion wheel 5*c* and 5*d* to rotation alone its rotational axis R-R' causing the coupled cleaning device 18 to move and to loosen up any accumulated debris or to move the debris out of the rain gutter 200. As described hereafter, the motion wheel can be configured to have rain water flowing at its lower side to spin the motion wheel in a spinning direction 12*b* (FIG. 12 and FIG. 13).

In examples, motion wheels 5*c* and 5*d* each can comprise a number of chambers 140 that can be pushed by down flowing water 207' to drive the motion wheels to spin at the spinning direction 12*b*. The motion wheels 5*c* and 5*d* can be affixed together co-axially alone the rotational axis R-R'. There can be two co-axial coupling wheels configured to be positioned between the motion wheels 5*c* and 5*d*. One of the coupling wheels can be connected to the cleaning member, such as shown in FIG. 13. The other coupling wheel can be, optionally, connected to the set of motion connectors 13 that is connected to a crank wheel 212 such as the manual motion device 1*a* shown in FIG. 11, for manual operation. In further examples, one of the co-axially affixed coupling wheels can be a uni-directional wheel and is configured to have a uni-directional clutch or a uni-directional restrictor so that only the uni-directional wheel can cause the motion wheels to turn, not vis versa. This can be useful when a cranking device is connected via the motion connectors 13 so that only the cranking device can turn the motion wheels, while when the motion wheels are turned by rain water, the connected cranking device 210 is not being turned constantly.

A representative schematic illustration of one example of an assembled and installed system is shown in FIG. 14: a cleaning device can be assembled and installed at the upper opening 201 of a downspout 111 coupled to a rain gutter 200; a set of motion connectors 13 can be assembled and connected to the cleaning device within the downspout 111 by connecting upward to the cleaning member; the set of motion connectors 13 can be routed downward within the downspout 111 through a first elbow 105 and a second elbow 108 down the downspout; the motion connectors 13 can then be connected to the motion device that is assembled and installed by connecting to the lower opening 202 of the downspout (the motion device can be installed at a lower portion 203 of the downspout); and an debris removal device and a debris exit 202*a* can be assembled and installed immediately above the motion device connecting to the downspout. The system can further comprise an optional ground exit 202*b* that can be connected to the lower end of the motion device. The ground exit 202*b* can have various exiting angles to allow water to exit the downspout to the ground, sewage system or a water collection system such as one or more water tanks or a seepage system. The rain gutter 200 and the downspout 111 can be affixed under a roof 204 and along a wall 205. The motion device 1, manual motion device 1*a* and wheel motion device 1*b* can be suitable.

The system of this invention can comprise the motion members configured to be positioned in two separate downspouts, wherein the partition member 14 can be combined with or replaced by a downspout 111 or a subsequent device housing. In examples, a single driver motion device 1*c* comprising a pair of single motion member devices can be suitable. The single driver motion device 1*c* can comprise a first device housing 3*a* and a second device housing 3*b*. A first motion member 5 can be positioned in a first partition 15 formed by the first device housing 3*a* and a second motion member 5*a* can be positioned in a second partition 16 formed by the second device housing 3*b*. The set of motion connectors 13 can connect the first motion member 5 and the second motion member 5*a*, wherein the set of motion connectors 13 can go through downspouts 111 connected to the first device housing 3*a* and the second device housing 3*b* and the coupled rain gutter 200 (FIG. 15). In an example of this configuration, the cleaning pulley 103 and the coupling pulley 123 can be combined and can be supported by a set of gutter connecters 17.

In one configuration, a direction device 7 comprising set of direction plates 121 and a direction support 122 that can be positioned in the single driver motion device 1*c*. In this configuration, a motion member coupler 8, direction connecters 121*a* and 121*b* and motion connectors 13 can be combined or coupled together, such as shown in FIG. 15. The cleaning member can be connected with the set of motion connectors 13. When the first motion member is at the top position, a direction plate 121 positioned in the first device housing 3*a* can open the first partition 15 and another direction plate 121 positioned in the second device housing 3*b* can close the second partition 16 leading to the inflow liquid 10, such as rain water, to flow into the downspout into the first partition 15 accumulating in the first motion member 5, while at the same time, the second motion member 5*a* reaches the lower end of the single driver motion device 1*c* and the second gating device 6*a* is then triggered to open, for example, by the gating device trigger 129, allowing the accumulated liquid to exit the motion member 5*a* through the second gate opening 119*a* as outflow liquid 11 (FIG. 15). When the first motion member 5 is filled with water and forced to move down, the direction plate 121 positioned in the first device housing 3*a* can close the first partition 15 and the other direction plate 121 positioned in the second device housing 3*b* can open the second partition 16 leading to the inflow liquid 10, such as rain water, to flow into the downspout into the second partition 16 accumulating in the second motion member 5*a*. The motions of the motion members can be repeated as long as the liquid such as rain water is flowing down the downspout generating oscillating motions leading to oscillating motions of the cleaning member 104 along the rain gutter 200, the connected downspout 111, or a combination thereof, loosening up or moving leaves or debris. Although gating device having a ball valve 128 is shown in FIG. 15, other gating devices, such as those shown in FIG. 2A, FIG. 2C-2D and FIG. 3A can also be suitable. When a direction plate 121 closes a partition, liquid, such as rain water can still flow through the downspout where the direction plate 121 is positioned by going around the motion member. The down flowing water can exit the downspout through a retention device plate 130 that can be a net shown in FIG. 3E. A single driver motion device 1*c* can further comprise a secondary partition member 14*a* that can be coupled to the support plate 122 to form a first secondary partition 15*a* within the first device housing 3*a* and a subsequent secondary partition 16*a* within the second device housing 3*b*, wherein the motion member 5 can be positioned in the first secondary partition 15*a* in the first device housing 3*a* and the second motion member 5*a* can be positioned in the subsequent secondary partition 16*a* in the second device housing 3*b* (FIG. 15). The secondary partition can help to reduce or eliminate undesired water accumulation in a motion member.

In a system of this invention, a downspout can be inserted into a motion device so an exit of the downspout can be immediately above the direction support plate 122 and direction plate 121 and so positioned that all water flowing through the downspout can be directed to one of the partitions 15 or 16 depending on the position of the direction plate 121 as shown in dashed lines in FIG. 2B and FIG. 15.

The system of this invention can further comprise a sound assembly comprising at least one sound device. The sound assembly can be coupled to a motion device to produce sound when the motion device is generating uni-directional motions or oscillating motions. Some representative examples and various configurations are shown in FIG. 16A-FIG. 16E. A sound assembly 227 can comprise at least one sound device 224, a sound device connector 223 and a sound motion frame 222.

Figure 16A:
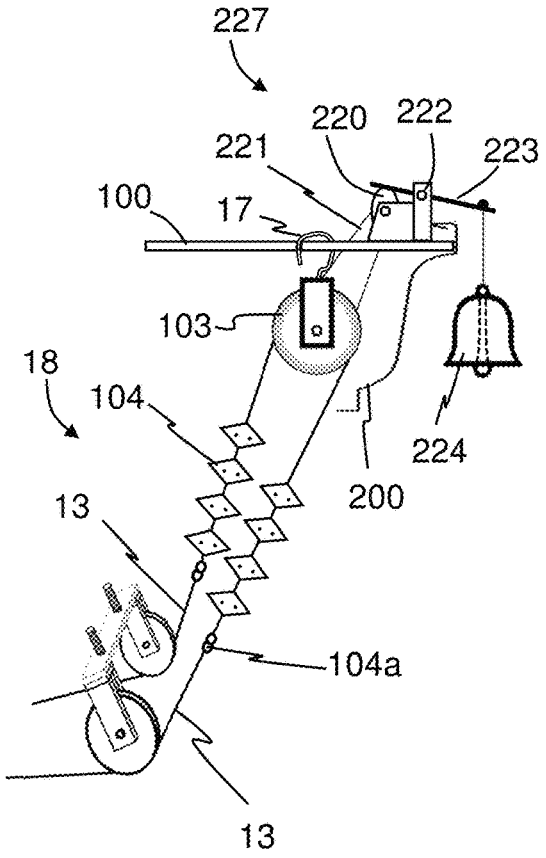
FIG. 16A-FIG. 16E. Schematic illustrations of examples of a sound assembly comprising at least one sound device and its various configurations.

In one example of a configuration, a sound assembly 227 can be coupled to a cleaning member 104 and installed together with the cleaning device over a rain gutter 200 connected to a motion device via a set of motion connectors 13 (FIG. 16A). The sound assembly can further comprise an asymmetrical wheel 220 and a sound connector 221 that is connected to a cleaning pulley 103. When the motion device is powered by rain water, the cleaning pulley 103 can be driven by the set of motion connectors 13 and drive the asymmetrical wheel 220 via the connected sound connector 221, causing the sound device 224 to move producing sounds. The sound assembly can be useful for indicating the motion device is functioning. The sound assembly can also be used for producing sound when it is raining.

Figure 16B:
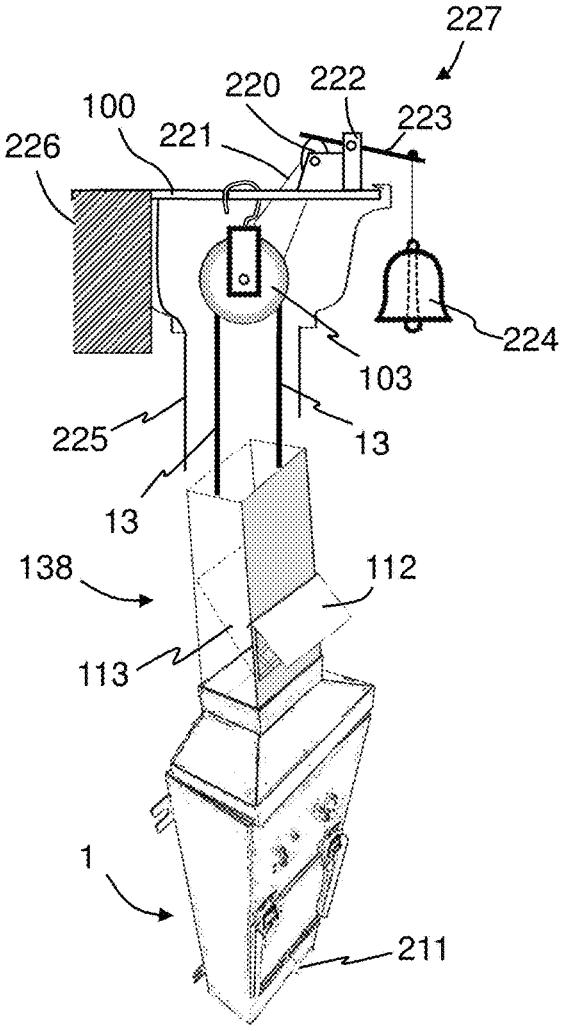
Figure 16C:
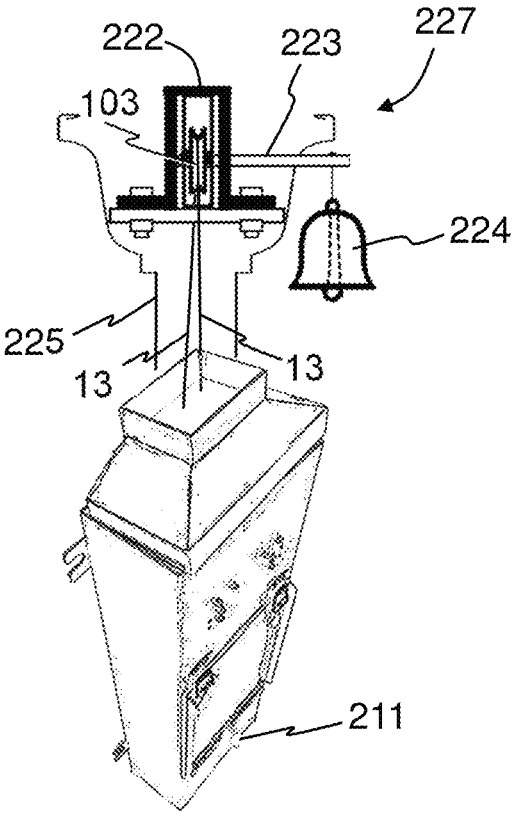
Figure 16D:
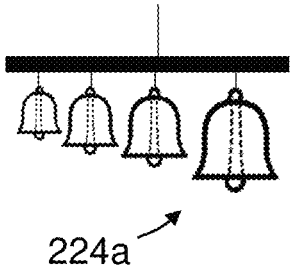
Figure 16E:
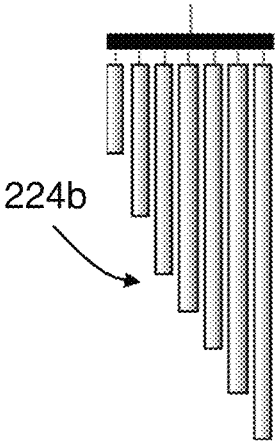

In another example of a configuration, a sound assembly 227 can be coupled to a motion device via a set of motion connectors 13 without being connected to a cleaning device (FIG. 16B). In yet another example of a configuration, a sound assembly 227 can be coupled to a motion device via a set of motion connectors 13 as a stand-alone device (FIG. 16C). The sound device can be a bell (FIG. 16A-FIG. 16C), a set of bells (FIG. 16D), a set of sound pipes (FIG. 16E), other objects that can produce sound, or a combination thereof. A sound assembly can be installed at a rain gutter, such as shown in FIG. 16A, at a structure support 226 such as a house, a tree or a structure (FIG. 16B), or stand alone, such as shown in FIG. 16C. A funnel device 225 can be used to facilitate the collection of rain water.

This invention is further directed to a kit for a system for de-clogging a rain gutter and a downspout coupled to the rain gutter. The kit of this invention can comprise a motion device selected from:

a first motion device comprising set of motion wheels configured to be coupled to the cleaning member of the cleaning device;

at least a second motion device comprising:

a device housing having an upper end 2 and a lower end 4 distal to each other along a longitudinal axis (Z-Z') of the device housing, a partition member 14 for forming a first partition 15 and a second partition 16, each is parallel to the longitudinal axis, and a direction device 7 for opening and closing the first partition 15 and the second partition 16 in alternate; and a first motion member 5 positioned in the first partition 15 and a second motion member 5*a* positioned in the second partition 16, the first motion member and the second motion member are coupled together via a motion member coupler 8 and each is movable parallel to the longitudinal axis, the first motion member 5 is configured, when it moves downward, to pull the second motion member 5*a* moving upward via the motion member coupler 8 and, in alternate, the second motion member 5*a* is configured, when it moves downward, to pull the first motion member 5 moving upward via the motion member coupler 8;

wherein, the direction device 7 is configured to open the first partition 15 and close the second partition 16 when the first motion member 5 is near the upper end 2 and the second motion member 5*a* is near the lower end 4, in alternate, the direction device 7 is configured to open the second partition 16 and close the first partition 15 when the second motion member 5*a* is near the upper end 2 and the first motion member 5 is near the lower end 4, and the direction device 7 is configured to open only one of the first and the second partition at a time;

wherein, the first partition and the second partition are positioned in the device housing; or the first partition is positioned in a first device housing and the second partition is positioned in a second device housing;

or a combination thereof;

wherein the motion device is configured to produce uni-directional motions or oscillating motions based on motions of a liquid flowing through the motion device caused by gravity when assembled.

The first motion device and the second motion device each is configured, when assembled, to drive uni-directional motions or oscillating motions of the cleaning member based on motions of a liquid flowing through the first or the second motion device caused by gravity. The liquid can comprise rain water and can be collected from a rain gutter and flow through a connected downspout through the motion device.

The wheel motion device 1*b* shown in FIG. 12 and FIG. 13 can be suitable as the first motion device. The motion device 1 described herein and shown various figures, such as FIG. 1A through FIG. 6 and FIG. 7 can be suitable as the second motion device. The single driver motion device 1*c* that is a motion device comprising a pair of single motion member devices described herein and shown in various figures, such as FIG. 15, can also be suitable as the second motion device.

The kit can further comprise:

a cleaning member;

a set of motion connectors, wherein the cleaning member and a set of motion connectors are configured to form a cleaning device when assembled, wherein the set of motion connectors 13 are configured to be connected to the first motion member 5 and the second motion member 5*a* when assembled;

two or more routing devices for routing the set of motion connectors to connect to at least the cleaning member; and optionally, a cranking device configured for manual operation of at least the cleaning device;

optionally, a debris removal device and a debris exit, the debris removal device and the debris exit are coupled together and both are configured to be positioned at a downspout when assembled; and optionally, a sound device configured to be coupled to the set of motion connectors.

The first motion member 5 and the second motion member 5*a* are configured to be connected to the set of motion connectors 13 when assembled.

The cleaning member 104, the motion connectors 13, the routing device 109 and the cranking device 210 including crank connector 213 described above and shown in FIG. 8A-8E, FIG. 9, FIG. 13, FIG. 15 and other various figures, in whole or in part, can be suitable.

The cranking device 210 can be pre-assembled with a device housing or a section of a downspout to form a manual motion device, such as the manual motion device 1*a* shown in FIG. 11.

The kit of this invention can further comprise a debris removal device 113, the debris exit 202*a* and the debris exit door 112 that can be pre-assembled to form a stand-alone debris removal assembly 138 and can be further pre-assembled with a motion device, such as a motion device 1 (FIG. 7 and FIG. 10). In one example, a debris removal assembly 138 can be comprise debris removal device 113, the debris exit 202*a* and the debris exit door 112 assembled in a section of a downspout that can be configured to be directly connected to below another section of a downspout and above the motion device 1. The debris exit 202*a* can be a cut out from a side of a downspout so configured to enable the debris removal device to remove debris, such as tree leaves, out of the downspout from the debris exit.

The kit can further comprise at least one optional cleaning connector 104*a* (FIG. 8B, FIG. 8D and FIG. 8E), a set of connector linkers 213*a* (FIG. 11), a gutter connecter 17 (FIG. 8B, FIG. 8D, FIG. 8E, FIG. 13 and FIG. 15) with a connected cleaning pulley and a gutter hanger. The gutter connecter 17 with the connected cleaning pulley 103 and the gutter hanger 100 described above and shown in various figures including FIG. 8B and FIG. 8D-8E can be suitable.

In the kit of this invention, the first motion member 5 can further comprise a first gating device 6 at the bottom of the first motion member 5 that is configured to be open when the first motion member 5 is at the lower end and to be closed when the first motion member 5 leaves the lower end, the second motion member 5*a* can further comprise a second gating device 6*a* at the bottom of the second motion member 5*a* that is configured to be open when the second motion member 5*a* is at the lower end and to be closed when the second motion member 5*a* leaves the lower end.

In the kit of this invention, the motion device can further comprise a first retention device 120 to hold the first motion member at the lower end and a second retention device 120*a* to hold the second motion member at the lower end, wherein the first retention device 120 is configured to release the first motion member 5 when a total weight of the first motion member is greater than a total weight of the second motion member by a pre-defined weight differential value, and the second retention device 120*a* is configured to release the second motion member 5*a* when a total weight of the second motion member is greater than a total weight of the first motion member by the pre-defined weight differential value, as described above.

Figure 6:
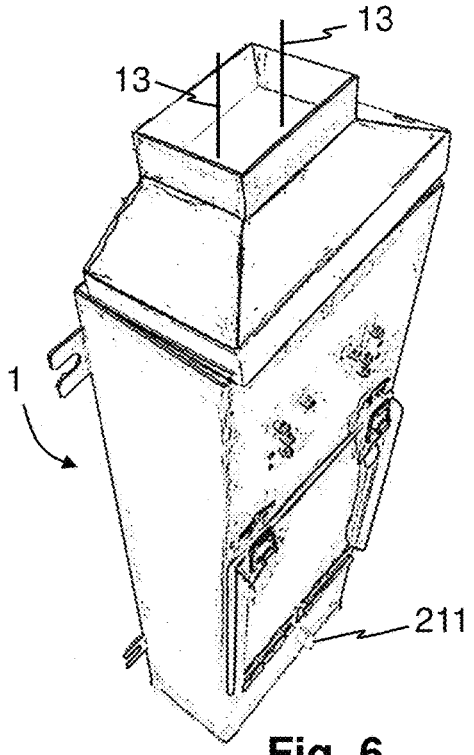
FIG. 6. A perspective view of an example of an assembled motion device.

The motion device 1 can be pre-assembled (FIG. 6). A pre-assembled motion device 1 and a debris removal assembly 138 can further be pre-assembled to form a unit (FIG. 7 and FIG. 10). The unit can be configured to connect to a section of a downspout from the debris removal assembly side. The unit can also be configured to further connect to another section of a downspout, such as a downspout having a ground exit 202*b* from the lower end 4 of the motion device 1. In one example, a motion device can be assembled in a downspout in a lower portion 203 as shown in FIG. 14.

The kit of this invention can further comprise a sound assembly. The sound assembly can be configured to be assembled together with a cleaning device. The sound assembly can also be configured to be assembled together with a motion device without the cleaning device. Examples of the sound assembly 227 shown in FIG. 16A-FIG. 16E can be suitable.

An objective of the present invention is to provide an automatic system, also referred to as an automatic gutter dredger or an automatic gutter cleaner, for de-clogging a rain gutter and a downspout that helps to keep the downspout unobstructed whenever it is raining. Another objective of the present invention is to reduce or eliminate the requirement for periodic cleaning of the rain gutters and downspouts and to replace such periodic cleaning with the automatic system disclosed herein.

In particular examples, a gutter dredger system can comprise two portions, an upper portion and a lower portion. The upper portion comprises a gutter hanger 100, a cleaning pulley 103, and a rope or belt as a set of motion connectors 13 hanging on the cleaning pulley 103. The cleaning pulley 103 is hung on the gutter hanger 100 above the rain gutter upside opening (FIG. 8A and FIG. 8B). In most cases, a downspout can have two elbows, a first elbow 105 and a second elbow 108, below the gutter upside opening (FIG. 8A, FIG. 8D and FIG. 14) to position the downspout along the side of a house. A set of double routing pulleys 106 can be affixed at each of the elbows functioning as a routing device 109 to route the set of motion connectors 13 (FIG. 8D). A cleaning device can also comprise clips or shredding blades as shown in FIG. 8E. The clips or shredding blades can be affixed to the motion connector 13 by using screws or clamps and can be used to shred leaves when the cleaning member is in motion. The rope or belt can be hung on the cleaning pulley 103 and routing pulleys 106 and can move up and down smoothly in the downspout. The rope or belt may have down direction bristles, metal or hard plastic, which can function as a cleaning device for pulling debris down to the downspout or move debris out of the gutter upside opening. The upper portion can also comprise a motion device comprising a set of motion wheels, such as the wheel motion device 1*b* (FIG. 12 and FIG. 13).

Suitable for the invention disclosed herein, a rope can comprise strings, braided lines, wires, or other forms that can comprise metal strings, such as copper strings, steel strings, galvanized steel strings, aluminum strings, alloy strings, or a combination thereof; nylon (polyamide); polypropylene; polyester; LCAP (Liquid Crystal Aromatic Polyester); polyethylene; carbon fiber; Kevlar®, Twaron®, Technora® (Aramid) (under respective trademarks); PBO fiber, such as Zylon (poly(p-phenylene-2,6-benzobisoxazole)), a combination thereof, or other natural or man-made materials.

The lower portion can have a motion device disclosed herein (a motion device can also be referred to as "Water Powered Reciprocating Motor", or a "water motor"), such as the motion device 1 (such as the ones shown in FIG. 1A-FIG. 3A, FIG. 4-FIG. 7 and FIG. 10) or the manual motion device 1*a* (FIG. 11). In one example, a motion device can comprise one coupling pulley 123, two cups as the first and the second motion members 5 and 5*a* coupled with a motion member coupler 8, such as a rope or a belt (FIG. 2A and FIG. 3A) and other components, which can be installed in a section of a downspout 111 or a stand-alone device housing 3. Each cup can have a hole at the bottom as a gate opening 119 or 119*a* and a piston 116 coupled to a connection rod 118 and a second rod 117 above the hole as a gating device 6 or 6*a* (FIG. 1A-1B, FIG. 2A, FIG. 2C-2D, and FIG. 3A). When a first cup (such as the first motion member 5) is moving up, the piston 116 closes the gate opening 119. When the first cup touches the surface of the bottom of the device, for example, a solid net as the retention device plate 130, the piston 116 is pushed up above the opening and the opening can be open leading to the water contained within the cup to flow out through the gate opening 119. To make sure rain water only flow into one cup at a time, a plate with two holes can be installed above the cups functioning as a direction support 122 of a direction device 7. A smaller plate (direction plate 121) can be positioned above the direction support plate 122. When a cup moves up to the coupling pulley 123, it moves the smaller plate to the other side to close the hole and opens the hole above itself (FIG. 2C-2D). The solid net can be installed at the bottom of the downspout or a device housing. A retention device, such as the retention device 120 and 120*a* (FIG. 3A), for example, a magnet/metal plate or a friction device, can be installed on the solid net to hold the cup until the other cup is almost full and a pre-defined weight differential value is reached.

A debris removal device, such as the debris removal device 113, can be installed above the cups in case the cups are clogged by the debris (FIG. 3A-3B, FIG. 7 and FIG. 10).

The Water Powered Reciprocating Motor, i.e., the motion device, can move a rope or belt in the downspout up and down automatically whenever it is raining. The moving rope or belt can help to keep the downspout unobstructed. The flowing water can also flash the debris down and can discharge the debris from the debris exit 202*a* (FIG. 10).

One example is shown in FIG. 3A-3E that is a schematic illustration of a front sectional view of the lower portion of the gutter dredger of the present invention installed in a downspout 111 including a debris removal device 113, a direction support 122 guiding the rain water to a first cup (motion member 5) and a second cup (motion member 5*a*), a coupling pulley 123 with a motion member coupler 8 that is a rope hung below the direction support 122, the two cups each with a hole and a piston 116 at the bottom hung on a rope (motion member coupler 8), and a solid net such as the retention device plate 130 at the lower end of the downspout 111. The downspout can be separated into two cavities (partitions) by a plate, such as a partition member 14. The debris removal device 113 can have an exit door 112 to move the debris out while keeping foreign objects from getting into the downspout. A piston 116 is installed inside a hole of the cup connected with a connection rod 118. The piston 116 can seal the hole when the cup moves above and away from the solid net such as retention device plate 130. A second rod 117 can prevent the connection rod 118 from being pushed into the cup when the bottom of the cup touches the solid net 130. A rope, such as a set of motion connectors 13 from the upper portion passes debris removal device 113 and the direction support 122 via a set of direction pulley 127, and connected to the cups, such as the motion members 5 and 5*a*. When assembled and in operation, one of the cups can pull the rope, such as the motion connectors 13 down when the cup is moving down (See FIG. 3A and other figures). When the cup, such as the motion member 5 touches the solid net (retention device plate 130), for example, the other cup will push a light trapezoid frame 126 up and causing the trapezoid frame to push the direction plate 121 to the other side, opening the hole on the bigger plate above it, and close the hole on the bigger plate on the other side (FIG. 2C-2D, FIG. 3A and FIG. 3C). A retention device 120 will hold the lower cup on the solid net (retention device plate 130) until the other cup is almost full with the rain water and a pre-defined weight differential value is reached.

Another example of an installed system is shown in FIG. 8A that shows a schematic illustration of a side sectional view of the upper portion of the gutter dredger cleaning device placed in a rain gutter 200. The gutter hanger 100 is installed on the rain gutter 200 having a rain gutter side wall 102 above the drop outlet of the downspout (downspout upper opening 201). A cleaning pulley 103 is hung on the hanger 100 and a set of motion connectors 13 that can be a rope or belt hung on the pulley can be installed inside the downspout. Downspout first elbow 105 and second elbow 108 can typically include bends which can be as sharp as ninety degrees (FIG. 8A and FIG. 8D). It may make the set of motion connectors 13, such as a rope to slide over very hard. To solve such issue, the system can comprise two routing devices 109 having a first set of routing pulleys 106 and a second set of routing pulleys 107, such as shown in FIG. 8D. Two double pulleys, such as the first set of routing pulleys 106 and the second set of routing pulleys 107 can be affixed at the first elbow 105 and the second elbow 108, respectively. The set of motion connectors 13, such as a rope can drop to the ground (lower portion) inside the downspout through the first set of routing pulleys 106 and the second set of routing pulleys 107. The set of motion connectors 13 can be connected to a motion device disclosed herein.

In yet another example, a downspout 111 has a lower opening 202 that is between the downspout and a motion device 1. The motion device 1 can be installed within the downspout in a lower portion 203. The motion device and the lower opening are both located above the ground 206. The system can further comprise an optional ground exit 202*b* that can be connected to the lower end of the motion device (FIG. 14). The ground exit 202*b* can have various exiting angles to allow water to exit the downspout to the ground, sewage system or a water collection system such as one or more water tanks or a seepage system.

The system of this invention can be installed together with rain gutter and downspout when a house is built. The system can also be installed by retrofitting the rain gutter and downspout that has already been installed. The system can further be installed as an add-on.

One advantage of the system disclosed herein is that it is designed to automatically de-clog a rain gutter and a downspout when it rains, therefore helping to reduce or eliminate the needs for frequent manual cleaning.

Another advantage of the system disclosed herein is that it does not require electric power when cleaning the gutter and the downspout. Traditional power tools, for example, vacuum machines, require the use of electric power source to remove debris, such as leaves. The system of this invention can be automatically running whenever it rains.

Yet another advantage of the system disclosed herein is that a debris exit can be configured at a lower portion of a downspout accessible from the ground, such as illustrated in FIG. 14, so it is easy to get cleaned without the need to climb up a ladder to reach the rain gutter at the roofline of a house.

Yet another advantage of the system of this invention is that the cleaning member can have oscillating motion so the debris can be loosened up not accumulating, thus the system is less likely to get clogged for a long period of time and can be automatically self-cleaned whenever it rains.

This invention is further directed to a sound assembly. The sound assembly can comprise at least one sound device. The sound assembly can further comprise a sound device connector coupled to the sound device and a sound motion frame coupled to the sound device connector. The sound motion frame can be use used to install the sound assembly to a desired location. The sound assembly can be coupled to a motion device disclosed herein to produce sound when the motion device is in motion. Some representative examples and various configurations are shown in FIG. 16A-FIG. 16E. In one example, a sound assembly 227 can comprise at least one sound device 224, a sound device connector 223 and a sound motion frame 222. Other examples of configurations shown in FIG. 16A-FIG. 16C and described in details above can be suitable. The sound assembly can be useful for indicating a motion device disclosed herein is functioning. The sound assembly can also be used for producing sound when it is raining.

The sound device can be a bell (FIG. 16A-FIG. 16B), a set of bells 224*a* (FIG. 16D), a set of sound pipes 224*b* (FIG. 16E), other objects that can produce sounds, or a combination thereof. A sound assembly can be installed at a rain gutter, such as shown in FIG. 16A, at a structure support 226, such as shown in FIG. 16B, or stand alone, such as shown in FIG. 16C. A funnel device 225 can be used to facilitate the collection of rain water.

Some parts of the devices and labels are shown below:

1: motion device
1*a*: manual motion device having cranking device
1*b*: wheel motion device having motion wheels
1*c*: single driver motion device
2: upper end (of a motion device)
3: device housing
3*a*: first device housing (for single driver motion device 1*c*)
3*b*: second device housing (for single driver motion device 1*c*)
4: lower end (of a motion device)
5: first motion member
5*a*: second motion member
5*c*: motion wheel
5*d*: motion wheel
6: first gating device
6*a*: second gating device
7: direction device
8: motion member coupler
9: accumulated liquid (in a motion member)
10: inflow liquid (flow into a motion device)
11: outflow liquid (flowing out from a motion device)
12: motion directions
12*a*: oscillating directions
12*b*: spinning direction (of a motion wheel)
13: motion connectors
14: partition member
14*a*: secondary partition member
15: first partition
15*a*: first secondary partition (of a single driver motion device 1*c*)
16: second partition
16*a*: subsequent secondary partition (of a single driver motion device 1*c*)
17: gutter connecter
18: cleaning device
20: motion distance d
100: gutter hanger
102: rain gutter side wall
103: cleaning pulley
104: cleaning member
104*a*: cleaning connector
105: first elbow (of a downspout)
106: routing pulleys
107: second routing pulley
108: second elbow (of a downspout)
109: routing device
111: downspout
112: exit door
113: debris removal device
116: piston (of a gating device)
117: second rod (of a gating device)
118: connection rod (of a gating device)
119: first gate opening
119*a*: second first gate opening
120: first retention device
120*a*: second retention device
121: direction plate

122: direction support
123: coupling pulley (coupling the motion members)
126: trapezoid frame (first)
126*a*: trapezoid frame (second)
127: direction pulley
128: ball valve (of a gating device)
129: gating device trigger
130: retention device plate
131: additional magnetic plate
138: debris removal assembly
140: chambers (of the motion wheels 5*c* and 5*d*)
200: rain gutter
201: upper opening (of a downspout)
202: lower opening (of a downspout)
202*a*: debris exit (of a downspout)
202*b*: ground exit (of a downspout)
203: lower portion (of a downspout)
204: roof
205: wall
206: ground
207: rain water (flow into a rain gutter)
207': down flowing water (in a downspout)
208: water without debris
209: outflow debris
210: cranking device
211: crank axle
212: crank wheel
213: crank connector
213*a*: connector linkers (of the cranking device)
214: crank handle
215: rotating directions (of the cranking device)
220: asymmetrical wheel
221: sound connector
222: sound motion frame
223: sound device connector
224: sound device
224*a*: set of bells
224*b*: set of sound pipes
225: funnel device
226: structure support The instant disclosure now will be further exemplified in the following non-limiting examples.

EXAMPLES

The present invention is further defined in the following Examples. It should be understood that these Examples, while indicating preferred embodiments of the invention, are given by way of illustration only. From the above discussion and these Examples, one skilled in the art can ascertain the essential characteristics of this invention, and without departing from the spirit and scope thereof, can make various changes and modifications of the invention to adapt it to various uses and conditions.

Example 1

Cleaning of Rain Gutter and Downspout Using Water Supply

A de-clogging system comprising a motion device 1 and a cleaning device 18 was installed in a gutter and a downspout at a side of a house. A water hose was used to supply water to the rain gutter. The supplied water was draining into the connected downspout feeding to the motion device 1 installed at the lower portion of the downspout. The water filled in one cup that had a capacity of about 500 mL pulling the cleaning member moving in one direction. The cup was equipped with a ball valve 128 (FIG. 2B) as a gating device. Once the cup reached the bottom, the ball valve was pushed up causing the water in the cup to discharge. At the same time the second cup was filled in with water. Once the second cup was filled about full and the first cup about to completely discharge, the weight of the second cup and the water it contained caused the first cup to break free from the retention force between a magnetic retention device and the metal net as the retention device plate 130. The second cup moved down and the first cup moved up. The motions cycled as long as the water was supplied.

Example 2

Automatic Cleaning of Rain Gutter and Downspout When Raining

A system as in Example 1 was exposed to rain. Rain water activated the system and caused the cleaning member to have oscillating motions as described above to clean the rain gutter and downspout.

Example 3

Automatic Cleaning of Rain Gutter and Downspout When Raining with a Motion Device Comprising a Pair of Trapezoid Frames A de-clogging system comprising a motion device 1 as shown in FIG. 3A was used. The system had a pair of trapezoid frames as a part of the direction device as shown in FIG. 2C, FIG. 2D and FIG. 3A. The system was exposed to rain. Rain water activated the system and caused the cleaning member to have oscillating motions as described above to clean the rain gutter and downspout.

Example 4

Automatic Cleaning of Rain Gutter and Downspouts with a Motion Device Comprising a Pair of Single Driver Motion Devices A pair of single driver motion devices each comprising a single motion member were installed in a pair of downspouts connected with a section of rain gutter as shown in FIG. 15. The system was exposed to rain. Rain water activated the system and caused the motion members to move up and down leading to horizontal oscillating motions of the cleaning member to clean the rain gutter, and vertical oscillating motions to clean the downspouts. A gating device having a ball valve 128 was used in each of the pair of the single driver motion devices.

What is claimed is:

1. A process for de-clogging a rain gutter and a downspout coupled to said rain gutter, said process comprising causing uni-directional motions or oscillating motions of a cleaning member of a cleaning device coupled to a set of motion connectors, said cleaning device is positioned within a portion of said rain gutter, said downspout or a combination thereof, wherein said uni-directional motions or oscillating motions are caused by manual operations, caused by directing a liquid from an upper opening of said downspout that is coupled to said rain gutter through said downspout to a motion device functionally coupled to said set of motion connectors, or a combination thereof, wherein said motion device is configured to drive said uni-directional motions or oscillating motions of said cleaning member based on motions of said liquid flowing through said downspout and through said motion device caused by gravity.

2. The process of claim 1, wherein said uni-directional motions or oscillating motions are caused by manual operations of a cranking device coupled to said set of motion connectors.

3. The process of claim 1, wherein said uni-directional motions or oscillating motions are caused by said motion device.

4. The process of claim 3, wherein said motion device is configured to comprise:

a first motion member and a second motion member, wherein said first motion member and said second motion member are coupled together and each is further coupled to said set of motion connectors, said first motion member and said second motion member are configured to generate said oscillating motions based on the downward motion of said liquid through said downspout and through said motion device caused by gravity, and a device housing having an upper end and a lower end distal to each other along a longitudinal axis of said device housing, a partition member for forming a first partition and a second partition, each is parallel to said longitudinal axis, and a direction device for opening and closing said first partition and said second partition in alternate;

wherein, said first motion member is positioned in said first partition and said second motion member is positioned in said second partition, said first motion member and said second motion member are coupled together via a motion member coupler and each is movable parallel to said longitudinal axis, said first motion member is configured, when it moves downward, to pull said second motion member moving upward via said motion member coupler and, in alternate, said second motion member is configured, when it moves downward, to pull said first motion member moving upward via said motion member coupler; and wherein, said first partition and said second partition are positioned in said device housing; or said first partition is positioned in a first device housing and said second partition is positioned in a second device housing.

5. The process of claim 4, said process further comprising:

1) causing said first motion member to move downward when said first motion member is at said upper end and said second motion member is near said lower end by causing said direction device to open said first partition and close said second partition directing said liquid to accumulate in said first motion member forcing said first motion member to move downward and said second motion member to move upward;

2) allowing said accumulated liquid to exit through a first gate opening of said first motion member when said first motion member is at said lower end and said second motion member is at said upper end by triggering a first gating device of said first motion member to open;

3) causing said second motion member to move downward when said second motion member is at said upper end and said first motion member is at said lower end by causing said direction device to open said second partition and close said first partition, directing said liquid to accumulate in said second motion member forcing said second motion member to move downward and said first motion member to move upward;

4) allowing said accumulated liquid to exit through a second gate opening of said second motion member when said second motion member is at the lower end and said first motion member is at said upper end by triggering a second gating device of said second motion member to open; and 5) repeating steps 1)-5) generating said oscillating motions.

6. The process of claim 5, said process further comprises:

providing a first retention device to hold said first motion member at said lower end and a second retention device to hold said second motion member at said lower end in alternate, wherein said first retention device is configured to release said first motion member from said lower end when a total weight of said second motion member is greater than a total weight of said first motion member by a pre-defined weight differential value causing said second motion member to move downward, and in alternate, said second retention device is configured to release said second motion member from said lower end when a total weight of said first motion member is greater than a total weight of said second motion member by said pre-defined weight differential value causing said first motion member to move downward.

7. The process of claim 6, wherein said process is automatically repeated when said liquid is flowing downward through said downspout.

8. The process of claim 4, wherein said cleaning member is configured to move in a first direction when said first motion member is moving downward, and in alternate, said cleaning member is configured to move in a second direction that is opposite to said first direction, when said second motion member is moving downward.

9. The process of claim 3, wherein said motion device is configured to comprise:

a set of motion wheels coupled to said cleaning member of said cleaning device coupled to said set of motion connectors, wherein said motion wheels are configured to generate said uni-directional motions based on the downward motion of said liquid flowing through said downspout and through said motion device caused by gravity.

10. The process of claim 1, wherein said liquid is water supplied from a water source and directed to said upper opening of said downspout to flow downward through said downspout or rain water collected by said rain gutter and directed to said upper opening of said downspout to flow downward through said downspout.

11. The process of claim 1, wherein said cleaning device is configured to be positioned within said rain gutter through said upper opening of said downspout, in said downspout, or a combination thereof.

12. A system for de-clogging a rain gutter and a downspout coupled to said rain gutter, said system comprising:

a motion device and a cleaning device comprising a cleaning member functionally coupled to said motion device, wherein said motion device is configured to drive uni-directional motions or oscillating motions of said cleaning member based on motions of a liquid flowing through said rain gutter and said downspout and through said motion device caused by gravity, wherein said motion device comprises:

a set of motion wheels coupled to said cleaning member of said cleaning device, or, a device housing having an upper end and a lower end distal to each other along a longitudinal axis of said device housing, a partition member for forming a first partition and a second partition, each is parallel to said longitudinal axis, and a direction device for opening and closing said first partition and said second partition in alternate.

13. The system of claim 12, wherein said motion device comprises said device housing and a first motion member positioned in said first partition and a second motion member positioned in said second partition, said first motion member and said second motion member are coupled together via a motion member coupler and each is movable parallel to said longitudinal axis, said first motion member is configured, when it moves downward, to pull said second motion member moving upward via said motion member coupler and, in alternate, said second motion member is configured, when it moves downward, to pull said first motion member moving upward via said motion member coupler;

wherein, said first partition and said second partition are positioned in said device housing; or said first partition is positioned in a first device housing and said second partition is positioned in a second device housing;

said cleaning device comprises:

a set of motion connectors coupled to said cleaning member, wherein said set of motion connectors is further connected to said first motion member and said second motion member;

wherein, said direction device is configured to open said first partition and close said second partition when said first motion member is near said upper end and said second motion member is near said lower end, in alternate, said direction device is configured to open said second partition and close said first partition when said second motion member is near said upper end and said first motion member is near said lower end, and said direction device is configured to open only one of said first and said second partition at a time;

wherein said cleaning member is configured to have oscillating motions moving in a first direction when said first motion member is moving downward, and in alternate, said cleaning member is moving in a second direction that is opposite to said first direction, when said second motion member is moving downward;

wherein said first motion member further comprises a first gating device at the bottom of said first motion member that is configured to be open when said first motion member is at the lower end and to be closed when said first motion member leaves said lower end, said second motion member further comprises a second gating device at the bottom of said second motion member that is configured to be open when said second motion member is at the lower end and to be closed when said second motion member leaves said lower end; and wherein said first motion member further comprises a first retention device to hold said first motion member at said lower end and a second retention device to hold said second motion member at said lower end in alternate, wherein said first retention device is configured to release said first motion member from said lower end when a total weight of said second motion member is greater than a total weight of said first motion member by a pre-defined weight differential value causing said second motion member to move downward, and in alternate, said second retention device is configured to release said second motion member from said lower end when a total weight of said first motion member is greater than a total weight of said second motion member by said pre-defined weight differential value causing said first motion member to move downward.

14. The system of claim 13, wherein said motion device further comprises a cranking device coupled to said first motion member and said second motion member configured for moving said first motion member and said second motion member to generate said oscillating motions or coupled directly to said set of motion connectors configured to generate said oscillating motions.

15. The system of claim 13 further comprising:

one or more routing devices for routing said set of motion connectors through said downspout; and a debris removal device and debris exit, said debris removal device and said debris exit are coupled together and both are positioned at said lower opening of said downspout and above said motion device.

16. The system of claim 12, wherein said motion device comprises said set of motion wheels coupled to said cleaning member of said cleaning device, wherein said motion wheels are configured to generate a motion based on the downward motion of a liquid through said downspout and through said motion device caused by gravity or based on manual operations of a cranking device coupled to said motion wheels.

17. A kit for a system for de-clogging a rain gutter and a downspout coupled to said rain gutter, said kit comprising a motion device selected from:

a first motion device comprising a set of motion wheels configured to be coupled to said cleaning member of said cleaning device;

a second motion device comprising:

at least a device housing having an upper end and a lower end distal to each other along a longitudinal axis of said device housing, a partition member for forming a first partition and a second partition, each is parallel to said longitudinal axis, and a direction device for opening and closing said first partition and said second partition in alternate; and a first motion member positioned in said first partition and a second motion member positioned in said second partition, said first and said second motion member are coupled together via a motion member coupler and each is movable parallel to said longitudinal axis, said first motion member is configured, when it moves downward, to pull said second motion member moving upward via said motion member coupler and, in alternate, said second motion member is configured, when it moves downward, to pull said first motion member moving upward via said motion member coupler;

wherein, said direction device is configured to open said first partition and close said second partition when said first motion member is near said upper end and said second motion member is near said lower end, in alternate, said direction device is configured to open said second partition and close said first partition when said second motion member is near said upper end and said first motion member is near said lower end, and said direction device is configured to open only one of said first and said second partition at a time;

wherein, said first partition and said second partition are positioned in said device housing; or said first partition is positioned in a first device housing and said second partition is positioned in a second device housing;

or a combination thereof;

wherein said motion device is configured to produce uni-directional motions or oscillating motions based on motions of a liquid flowing through said motion device caused by gravity when assembled.

18. The kit of claim 17 further comprising:

a cleaning member;

a set of motion connectors, wherein said cleaning member and a set of motion connectors are configured to form a cleaning device when assembled;

wherein said set of motion connectors 13 are configured to be connected to said first motion member 5 and said second motion member 5*a* when assembled;

two or more routing devices for routing said set of motion connectors to connect to at least said cleaning member; and optionally, a cranking device configured for manual operation of at least said cleaning device;

optionally, a debris removal device and a debris exit, said debris removal device and said debris exit are coupled together and both are configured to be positioned at a downspout when assembled; and optionally, a sound device configured to be coupled to said set of motion connectors.

19. The kit of claim 18, wherein said first motion member further comprises a first gating device at the bottom of said first motion member that is configured to be open when said first motion member is at the lower end and to be closed when said first motion member leaves said lower end, said second motion member further comprises a second gating device at the bottom of said second motion member that is configured to be open when said second motion member is at the lower end and to be closed when said second motion member leaves said lower end.

20. The kit of claim 19, wherein said motion device further comprises a first retention device to hold said first motion member at said lower end and a second retention device to hold said second motion member at said lower end, wherein said first retention device is configured to release said first motion member when a total weight of the first motion member is greater than a total weight of said second motion member by a pre-defined weight differential value, and said second retention device is configured to release said second motion member when a total weight of the second motion member is greater than a total weight of said first motion member by said pre-defined weight differential value.

* * * * *